US006288370B1

(12) United States Patent
Ogawa et al.

(10) Patent No.: US 6,288,370 B1
(45) Date of Patent: Sep. 11, 2001

(54) HEAT TREATMENT APPARATUS AND HEAT DEVELOPMENT APPARATUS USING THE SAME

(75) Inventors: Masaharu Ogawa; Nobuyuki Torisawa, both of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/390,278

(22) Filed: Sep. 3, 1999

(30) Foreign Application Priority Data

Sep. 3, 1998 (JP) ..... 10-249940
Mar. 5, 1999 (JP) ..... 11-058926

(51) Int. Cl.[7] ..... B21B 27/06

(52) U.S. Cl. ..... 219/469; 219/216; 399/279; 399/328; 430/350; 432/60

(58) Field of Search ..... 219/216, 469, 219/470; 399/279, 285, 286, 328; 430/350, 353; 347/154; 432/60, 228; 492/46

(56) References Cited

U.S. PATENT DOCUMENTS 4,474,456 * 10/1984 Kobayashi et al. ..... 355/14 FU
6,007,971 * 12/1999 Star et al. ..... 430/350
6,077,649 * 6/2000 Torisawa ..... 430/353
6,077,810 * 6/2000 Imaeda ..... 503/201

* cited by examiner

*Primary Examiner*—Teresa Walberg
*Assistant Examiner*—Shawntina Fuqua
(74) *Attorney, Agent, or Firm*—Sughrue, Mion, Zinn, Macpeak & Seas, PLLC

(57) ABSTRACT

A is moved, the heating members heat treatment apparatus 18 for subjecting a sheet A, which must be subjected to heat treatment, to heat treatment by transferring the sheet along the surface of a heating member, the heat treatment apparatus incorporating: at least two heating members 120, 320 fixedly aligned in a direction in which the sheet A, which are arranged to subject the sheet A to heat treatment which is performed at a predetermined temperature; transferring mechanism for sliding and transferring the sheet A along the surface of each heating member; and a pressing mechanism 122, 322 for pressing at least a portion of the sheet A which is being transferred, against the surfaces of the heating members.

23 Claims, 15 Drawing Sheets

HEAT TREATMENT APPARATUS AND HEAT DEVELOPMENT APPARATUS USING THE SAME

BACKGROUND OF THE INVENTION

1. Field of the Invention

The present invention relates to a heat treatment apparatus for subjecting a sheet which must be subjected to heat treatment, to heat treatment and more particularly to a heat development apparatus for use in a recording operation which is performed in a dry system, such as an image recording operation using a dry material such that a wet process is not performed.

2. Description of the Related Art

An image recording apparatus for recording a medical image for use in a digital radiography system, a CT, an MR or the like which uses a heat accumulating fluorescent sheet is known. The foregoing apparatus employs a wet system for obtaining a reproduced image by performing a wet process after an image has been photographed or recorded on a silver-salt photo-graphic photosensitive material.

In recent years, a recording apparatus has attracted attention which employs a dry system in which the wet process is not performed. The foregoing recording apparatus is arranged to use a photosensitive and/or thermo-sensitive recording material or a film made of a heat development photosensitive material (hereinafter called "recording materials"). In the recording apparatus using the dry system, the recording material is irradiated (scanned) with a laser beam in an exposing section so that a latent image is formed. Then, the recording material is, in a heat development section, brought into contact with a heating means so that heat development is performed. Then, the recording material on which an image has been formed is discharged to the outside of the apparatus.

The dry system of the foregoing type is able to form an image in a shorter time as compared with the wet process. Moreover, the problem of a necessity of disposal of waste liquid produced in the wet process can be overcome. Therefore, increase in the demand of the dry system is expected.

The foregoing dry system is usually structured to incorporate the heat development section having a heating means which is a heating drum. An endless belt is wound along the surface of the heating drum for a predetermined angle so that a recording material is held and transferred by the heating drum and the endless belt. Thus, heat development is performed. If the tension of the endless belt becomes non-uniform owing to heat deterioration or the like, uniform contact between the recording material and the heating drum cannot be realized. Thus, irregular development occurs.

Since images for use in the medical field must have a high quality, the recording materials have significantly high sensitivity. If the state of contact with the heating drum encounters slight non-uniformity, the image quality excessively deteriorates.

In the heating means, a decrease in the temperature in an edge portion to which heat is not greatly supplied, in particular, contact between the surface of the heating member and the low-temperature sheet causes a temperature gradient of the heating member to occur in a direction in which the sheet is transferred. Since the foregoing temperature gradient cannot quickly be overcome, differences in the temperature occur in the surface of the sheet or among sheets in a case of a sequential process. Thus, there arises a problem in that the quality of a result of the heat treatment deteriorates.

When the recording material is held between the heating drum and the endless belt, there arises a problem in that buckling of an end portion causes undesirable folding and a crease.

SUMMARY OF THE INVENTION

In view of the foregoing, an object of the present invention is to provide a heat treatment apparatus which is capable of making the contact between the heating member and the recording material to be furthermore uniform, which is free from occurrence of adhesion of dust, undesirable folding and a crease, and which is able to realize furthermore, uniform heating so as to form a high-quality image free from irregular development.

The foregoing object can be achieved by the following structures according to the present invention.

(1) A heat treatment apparatus for subjecting a sheet, which must be subjected to heat treatment, to heat treatment by transferring the sheet along the surface of a heating member, the heat treatment apparatus comprising:

at least two heating members fixedly aligned in a direction in which the sheet, which must be subjected to heat treatment, and arranged to subject the sheet, which must be subjected to heat treatment, to heat treatment which is performed at a predetermined temperature;

transferring means for sliding and transferring the sheet, which must be subjected to heat treatment, along the surface of each heating member; and pressing means for pressing at least a portion of the sheet, which must be subjected to heat treatment and which is being transferred, against the surfaces of the heating members.

(2) A heat treatment apparatus according to (1), wherein the distance among the heating members is 50 mm or shorter.

(3) A heat treatment apparatus according to (1) or (2), wherein the temperature of each heating member is independently controlled.

The heat treatment apparatus having the above-mentioned structure and the heat development apparatus using the same are arranged to independently set and control the corresponding temperatures of heating members divided into sections in a direction in which the heat-development photosensitive material sheet or the photosensitive and thermosensitive recording material sheet is transferred. Thus, the difference in the temperature of the sheet can be reduced. Moreover, irregular development, which takes place owing to heat deterioration in a case of the endless belt being employed, can be prevented so that furthermore, uniform heating is realized. As a result, a high-quality image free from irregular development can be obtained.

A first aspect of the apparatus is a heat treatment apparatus for subjecting a sheet, which is to be subjected to heat treatment by transferring the sheet along the surface of a heating member, said heat treatment apparatus which comprises:

at least two heating members fixedly aligned in a direction in which the sheet is transferred and arranged to subject the sheet to heat treatment which is performed at a predetermined temperature;

transferring means for sliding and transferring the sheet along the surface of each heating member; and pressing means for pressing at least a portion of the sheet which is being transferred, against the surfaces of said heating members.

A second aspect of the apparatus is a heat treatment apparatus according to the first aspect, wherein the distance among said heating members is 50 mm or shorter.

A third aspect of the apparatus is a heat treatment apparatus according to the first aspect, wherein the temperature of each heating member is independently controlled.

A fourth aspect of the apparatus is a heat treatment apparatus according to the third aspect, wherein a temperature sensor is disposed at a most downstream position of each heating member.

A fifth aspect of the apparatus is a heat treatment apparatus according to the fourth aspect, wherein the heat capacity of the heating member disposed in an upstream inlet portion in the direction in which the sheet, being subjected to heat treatment, is transferred, is larger than the heat capacity of the heating member disposed downstream.

A sixth aspect of the apparatus is a heat treatment apparatus according to any one of the first to fourth aspects, wherein each heating member incorporates an inclined sliding surface for sliding and guiding the leading end of the sheet, being subjected to heat treatment, at an upstream end in the direction in which the sheet is transferred.

A seventh aspect of the apparatus is a heat treatment apparatus according to any one of the first to fourth aspects, wherein said pressing means is composed of a plurality of pressing rollers urged against the surfaces of said heating members.

An eighth aspect of the apparatus is a heat treatment apparatus according to the seventh aspect, wherein said pressing rollers also serve as transferring means connected to rotating means and sliding and transferring the sheet along the surface of each heating member.

A ninth aspect of the apparatus is a heat treatment apparatus according to the eighth aspect, wherein said pressing rollers are rotated at the same peripheral velocity.

A tenth aspect of the apparatus is a heat treatment apparatus according to any one of seventh to ninth aspects, wherein the intervals of said pressing rollers provided for said heating members disposed in the upstream inlet portion in the direction in which the sheet is transferred is made to be closer than the intervals of the pressing rollers of the other heating members.

An eleventh aspect of the apparatus is a heat treatment apparatus according to any one of seventh to tenth aspects, wherein the shaft of each pressing roller is able to move closer and away in a direction towards the surface of said heating member and urged by a spring.

A twelfth aspect of the apparatus is a heat treatment apparatus according to the eleventh aspect, further comprising a member for holding said spring to adjust the load of said spring so as to make the pressure of each pressing roller which is applied to the sheet to be the same.

A thirteenth aspect of the apparatus is a heat treatment apparatus according to the seventh aspect, wherein the distance which allows each pressing roller to move backwards and forwards is in the range from 0.05 mm to 0.65 mm.

A fourteenth aspect of the apparatus is a heat treatment apparatus according to any one of first to thirteenth aspects, wherein said transferring means is a conveying belt movably disposed between said pressing rollers which are said pressing means and said heating members and having surface frictional force with which said sheet can be slid on the surface of each heating member so as to convey said sheet.

A fifteenth aspect of the apparatus is a heat treatment apparatus according to the fourteenth aspect, wherein said conveying belt has a coefficient of friction with respect to the sheet, which is higher than that of the surface of each heating member.

A sixteenth aspect of the apparatus is a heat treatment apparatus according to the fifteenth aspect, wherein the surface of said conveying belt opposite to the sheet is nappy.

A seventeenth aspect of the apparatus is a heat treatment apparatus according to any one of fourteenth to sixteenth aspects wherein said conveying belt has gas permeability.

An eighteenth aspect of the apparatus is a heat treatment apparatus according to any one of seventh to seventeenth aspects, further comprising a sub-roller disposed between said heating members and arranged to assist the transference of the sheet.

A nineteenth aspect of the apparatus is a heat treatment apparatus according to any one of first to eighteenth aspects, wherein said heating members are aligned flat on a flat plate or aligned to form a circular-arc configuration on a plate warped in the transferring direction.

A twentieth aspect of the apparatus is a heat treatment apparatus according to any one of first to nineteenth aspects, wherein at least a portion of each heating member is made of heat-conductive rubber.

A twenty-first aspect of the apparatus is a heat treatment apparatus according to any one of first to twentieth aspects, wherein the surface of each heating member which is made contact with the sheet is coated with fluororesin or provided with a processed sheet composed of fluororesin.

A twenty-second apparatus is a heat development apparatus for obtaining a visible image by transferring a photosensitive material sheet or a photosensitive and thermosensitive recording material sheet, on which a latent image has been formed and which is to be subjected to a heat-development, the sheet being in contact with heating means, said heat development apparatus comprising:

at least two heating members fixedly aligned in a direction in which the heat-development photosensitive material sheet or a photosensitive and thermosensitive recording material sheet is transferred and arranged to subject either sheet to heat treatment which is performed at a predetermined temperature;

transferring means for sliding and transferring either sheet; and pressing means for pressing at least a portion of the sheet which is being transferred against the surfaces of said heating members.

A twenty-third aspect of the apparatus is a heat development apparatus according to the twenty-second aspect, wherein said transferring means has transferring speed with which the sheet passes through the position of an outset gap between said heating members in the direction of the transference prior to a rise in the temperature of the sheet to a temperature at which development is started.

A twenty-fourth aspect of the apparatus is a heat development apparatus according to the twenty-third aspects the transference speed is determined to cause a temperature of the sheet to be in such a range, (room temperature +40° C.)<(the temperature of the sheet)<(development temperature−1° C.), at the position of the outset gap between said heating members in the direction of transference.

A twenty-fifth aspect of the apparatus is a heat development apparatus according to any one of the twenty-second to twenty-fourth aspects, wherein the temperature of each heating member is independently controlled.

A twenty-sixth aspect of the apparatus is a heat development apparatus according to the twenty-fifth aspect wherein one or more heating members are energized within permitted electric power in a decreasing order of difference in the temperature as compared with a set development temperature.

A twenty-seventh aspect of the apparatus is a heat development apparatus according to anyone of the twenty-second to twenty-sixth aspects, wherein each of said heating members is composed of a heater having a ratio of the thermal capacity and a heating plate.

A twenty-eighth aspect of the apparatus is a heat development apparatus according to anyone of the twenty-second to twenty-seventh aspects, wherein at least one of said heating members disposed in an upstream inlet portion in a direction in which the photosensitive and thermosensitive recording material sheet is transferred is divided into at least three sections in the widthwise direction of the sheet, and the temperature of each heating member can independently be set.

A twenty-ninth aspect of the apparatus is a heat development apparatus according to anyone of the twenty-second to twenty-eighth aspects, wherein the adjacent heating members are disposed apart from one another for a predetermined gap in a state in which the adjacent heating members are engaged to one another in a comb tooth manner.

BRIEF DESCRIPTION OF THE DRAWINGS

(FIG. 19 shows another example of the embodiment shown in FIG. 13.)

DETAILED DESCRIPTION OF THE PREFERRED EMBODIMENTS

Figure 1:
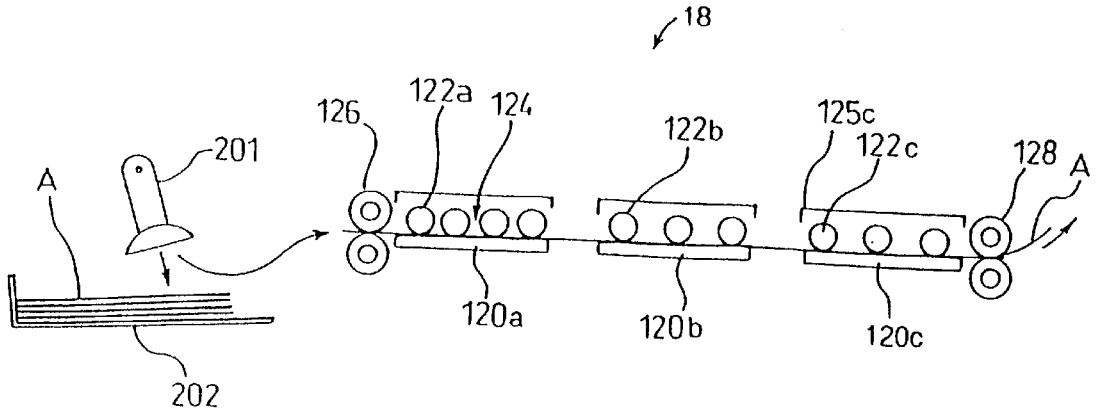
FIG. 1 is a schematic view showing the structure of a heat treatment apparatus according to a first embodiment of the present invention.

Referring to the drawings, the present invention will now be described.

FIG. 1 is a diagram showing the schematic structure of a heat treatment apparatus according to a first embodiment of the present invention.

The heat treatment apparatus according to this embodiment heats a sheet A which must be subjected to heat treatment. The heat treatment apparatus according to this embodiment incorporates three plate heaters 120*a*, 120*b* and 120*c* serving as heating members, the temperatures of which are raised to the levels required to process the sheet A. Moreover, a transferring means 126 is provided which relatively moves (slides) the sheet A with respect to each of the plate heaters 120*a*, 120*b* and 120*c* while the sheet A makes contact with the surface of each of the plate heaters 120*a*, 120*b* and 120*c*. In addition, there are provided pressing rollers 122*a*, 122*b* and 122*c* which are means for pressing the reverse side of the sheet A opposite to the surface of sheet A makes contact with the plate heaters 120*a*, 120*b* and 120*c* in order to transmit heat from the plate heaters 120*a*, 120*b* and 120*c* to the sheet A.

Each of the plate heaters 120*a*, 120*b* and 120*c* according to this embodiment is formed into a flat plate shape. Each of the plate heaters 120*a*, 120*b* and 120*c* incorporates a plate-like heating member which accommodates at least one heating means (for example, a nichrome wire) disposed flat so that their temperatures are maintained at the developing temperature for the sheet A. The material of the surface makes contact with the sheet A may simply be a heat conductive material. A structure incorporating a rubber heater disposed on the reverse side thereof may be employed. Another structure may be employed which uses hot air or which incorporates a lamp to heat the sheet A. It is preferable that the temperature of each heating means is independently controlled.

The plate heaters 120*a*, 120*b* and 120*c* are not required to have the same length. The length may arbitrarily be selected to meet the heat treatment conditions. As for the intervals among the heater, excessively long intervals deteriorate the efficiency of supplying heat to the sheet. Therefore, it is preferable that the intervals are 50 mm or shorter.

It is preferable that the surface of each of the plate heaters 120*a,* 120*b* and 120*c* is applied with a processed sheet having a surface of contact with the sheet material A which is made of fluorine resin or the surface of contact is applied with a coating in order to prevent a score which occurs when the sheet A is transferred.

Figure 2:
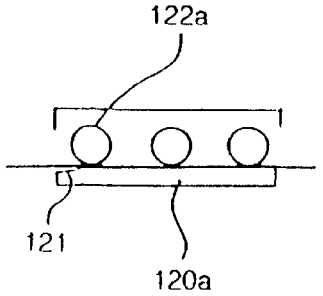
FIG. 2 shows a partially enlarged view showing the plate heater shown in FIG. 1.

Further, the side of each of the plate heaters 120*a,* 120*b* and 120*c* contacting with the sheet material A can be made of heat-conductive rubber on a surface of which a fluororesin layer is formed. According to the above structure, even if dust or trash is entered to a part between the sheet A and each of the plate heaters 120*a,* 120*b* and 120*c,* the elasticity of the rubber can inhibit a whitening of the part on development or a surface of the sheet A from being damaged. Further the fluororesin layer is effective to confirm a smoothness of the sheet A. FIG. 2 is a partially enlarged view showing the plate heater 120*a.* As shown in FIG. 2, an end of an inlet portion for the sheet A may be provided with an inclined surface 121 for sliding and guiding the leading end of the sheet A to prevent clogging. Also the other plate heaters 120*b* and 120*c* may have similar structures.

Again referring to FIG. 1, the first half of the heat treatment portion 18 requires greater quantity of heat to raise the temperature of the sheet A. Therefore, it is preferable that greater heat is supplied to the plate heater 120*a* disposed in the inlet portion of the heat treatment portion 18. To reduce the degree of local change in the temperature, the quantity of heat is larger than that of the plate heaters 120*b* and 120*c* disposed downstream.

As for the positions of temperature sensors for controlling the temperatures, the sensor must be provided for each of the plate heaters 120*a,* 120*b* and 120*c.* As for the positions, it is preferable that the sensor is disposed at the rear end of each plate heater to control the temperature of the sheet to the set temperature because the temperature in the downstream portion is higher and stable as compared with the temperature in the upstream portion.

The sheet A is sucked from an accumulating tray 202 by a sucking unit 201, and then the sheet A is guided to the heat treatment portion 18 through paired rollers 126 which are rotated by a rotating unit (not shown). Since the paired rollers 126 transfer the sheet A, the sheet A passes (slides) through spaces between the pressing rollers 122*a,* 122*b* and 122*c* and the corresponding plate heaters 120*a,* 120*b* and 120*c* so that heat treatment is performed.

The sheet A subjected to the heat treatment is discharged through a guide roller 128.

To prevent a score, it is preferable that contact of the surface of the sheet A, makes contact with the plate heaters 120*a,* 120*b* and 120*c,* with a surface having a function which requires heat treatment, is prevented. When the sheet must be observed carefully, contact of the surface, which must be observed, with each of the plate heaters 120*a,* 120*b* and 120*c,* must be prevented.

The plural pressing rollers 122*a,* 122*b* and 122*c* are provided for the corresponding plate heaters 120*a,* 120*b* and 120*c.* The pressing rollers 122*a,* 122*b* and 122*c* are disposed to make contact with either surface of each plate heater or at intervals shorter than the thickness of the sheet A along the overall length of the plate heaters 120*a,* 120*b* and 120*c* in the direction in which the sheet A is transferred. The pressing rollers 122*a,* 122*b* and 122*c* are disposed at predetermined pitches for each of the plate heaters.

That is, the sheet A is pressed such that the number of pressing position is enlarged in the inlet portion of the heat treatment portion 18. Moreover, the intervals of pressing are shortened in the inlet portion of the heat treatment portion 18. As a result, the portion of the sheet, where the temperature is raised, is strongly pressed, causing buckling of the sheet to be prevented. In addition, irregular temperature distribution can be prevented. When the means for pressing the sheet consists of the pressing rollers 122*a,* 122*b* and 122*c,* as is employed in this embodiment, it is preferable that the number of rollers for the plate heater 120*a,* in the inlet portion is enlarged to shorten the pitches of the rollers.

The rotating system for the pressing rollers 122*a,* 122*b* and 122*c* may be provided for each of the rollers 122*a–c.* In consideration of the cost and space of the apparatus, it is preferable that one rotating system is employed. As for the peripheral velocity of each of the rollers 122*a–c,* it is preferable that the velocities are the same to stably transfer the sheet. The velocity is determined by the heat treatment performance.

The pressing rollers 122*a,* 122*b* and 122*c* and the plate heaters 120*a,* 120*b* and 120*c* constitute a sheet transferring passage 124. The distance among the pressing rollers 122*a,* 122*b* and 122*c* and the plate heaters 120*a,* 120*b* and 120*c* is, in the sheet transferring passage 124, made to be shorter than the thickness of the sheet A. Thus, a state in which the sheet A can smoothly be held can be realized and buckling of the sheet A can be prevented. The paired transferring rollers 126 and the guide roller 128 which are sheet transferring means are disposed at the two ends of the sheet transferring passage 124.

As the pressing rollers, metal rollers, resin rollers, rubber rollers or the like may be employed. It is preferable that the thermal conductivity of the pressing rollers 122 is 0.1 W/m/° C. to 200 W/m/° C.

It is preferable that heat insulating covers 125*a,* 125*b* and 125*c* for insulating heat are disposed at positions opposite to the plate heaters 120*a,* 120*b* and 120*c* when the pressing rollers 122*a,* 122*b* and 122*c* are viewed as the centers.

When the leading end of the sheet A is made contact with the pressing rollers 122*a,* 122*b* and 122*c* during transference of the sheet A, the movement of the sheet A is interrupted momentarily. When the pressing rollers 122*a,* 122*b* and 122*c* are disposed apart from one another at the same pitches, the same portion of the sheet A is stopped at each of the pressing rollers 122*a,* 122*b* and 122*c.* Thus, the foregoing portion is pressed against the plate heaters 120*a,* 120*b* and 120*c* for a long time. As a result, the sheet A sometimes encounters formation of a striped irregular development extending in the widthwise direction of the sheet A. Therefore, it is preferable that the pitches of the pressing rollers 122*a,* 122*b* and 122*c* are made to be non-uniform.

As the means for transferring the sheet A, the paired transferring means 126 are employed which are disposed adjacent to the most upstream pressing roller 122*a* directly before the plate heaters 120*a,* 120*b* and 120*c.* As the foregoing transferring means, also the guide roller 128 may have the transferring force. Note that the transferring means is not limited to the foregoing means if the means is able to guide and transfer the sheet A to the heat treatment apparatus. Therefore, the means for transferring the sheet may be the roller 122 or a sheet transferring unit (not shown) may be provided for the sheet inlet portion or the sheet outlet portion.

Figure 3:
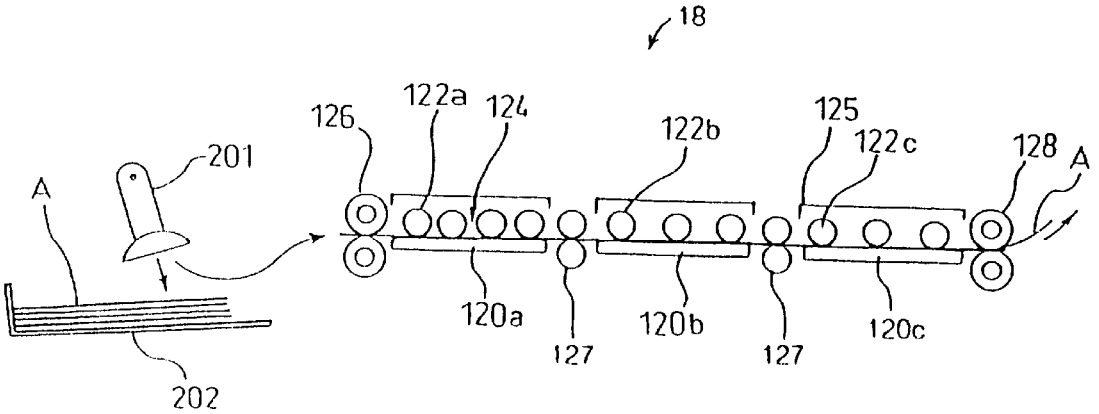
FIG. 3 shows a schematic view showing a heat treatment apparatus according to a second embodiment of the present invention.

FIG. 3 is a schematic view showing a heat treatment apparatus according to a second embodiment of the present invention. Referring to FIG. 3, sub-rollers 127 are provided among the plate heaters 120*a,* 120*b* and 120*c* to assist the transference of the sheet.

Figure 4:
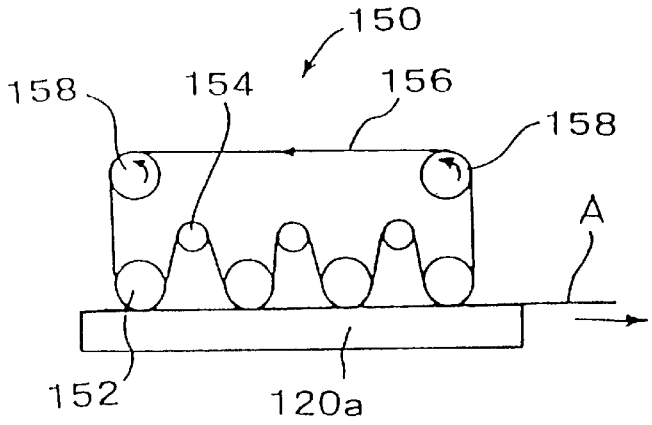
FIG. 4 shows a schematic view showing a heat treatment apparatus according to a third embodiment of the present invention.

FIG. 4 is a schematic view showing a heat treatment apparatus according to a third embodiment of the present invention and including another aspect of the means for conveying sheet A. The conveying unit 150 incorporates plate heaters 120*a,* 120*b* and 120*c* which are similar to those according to the foregoing embodiment. Therefore, only one plate heater 120*a* is illustrated. Note that each of the other plate heaters 120*b* and 120*c* has a similar structure.

A conveying belt 156 is caused to run along the surface of a drive roller 158, and then caused to run along the surface of a separation roller 154. At the position of the pressing roller 152, the sheet A is held between the plate heater 120*a,* and the conveying belt 156. Then, the conveying force of the conveying belt 156 is used to convey the sheet A. The conveying belt 156 has a coefficient of friction with respect to the sheet A, the coefficient of friction being higher than the coefficient of friction of the surface of the plate heater 120*a* with respect to the sheet A. Therefore, the sheet A can reliably be conveyed while the sheet A is being slid on the plate heater 120*a*. In the foregoing structure, the paired supply rollers 126 and the paired discharge rollers 128 are disposed similarly to those in the heat treatment apparatus 18 shown in FIG. 1. The separation roller 154 causes the conveying belt 156 to be brought into contact with the overall surface of the sheet A to prevent non-uniform distribution of the pressure that is applied to the sheet A. Thus, non-uniform heating can be prevented.

The surface of the conveying belt 156 opposite to the sheet A may be raised into a brush-like shape. In the foregoing case, the conveying performance can furthermore be improved. When the conveying belt 156 has gas permeability, gas produced owing to a chemical change occurring in the heat treatment layer of the surface of the sheet A can be discharged. Thus, adhesiveness between the sheet A and the plate heater can be improved.

The reason why the separation roller 154 is provided to previously separate the conveying belt 156 so as to prevent non-uniform contact between the sheet A and the plate heater 120*a,* in a region between pressing rollers 152. If the conveying belt 156 has gas permeability, the separation roller 154 may be omitted.

Figure 5:
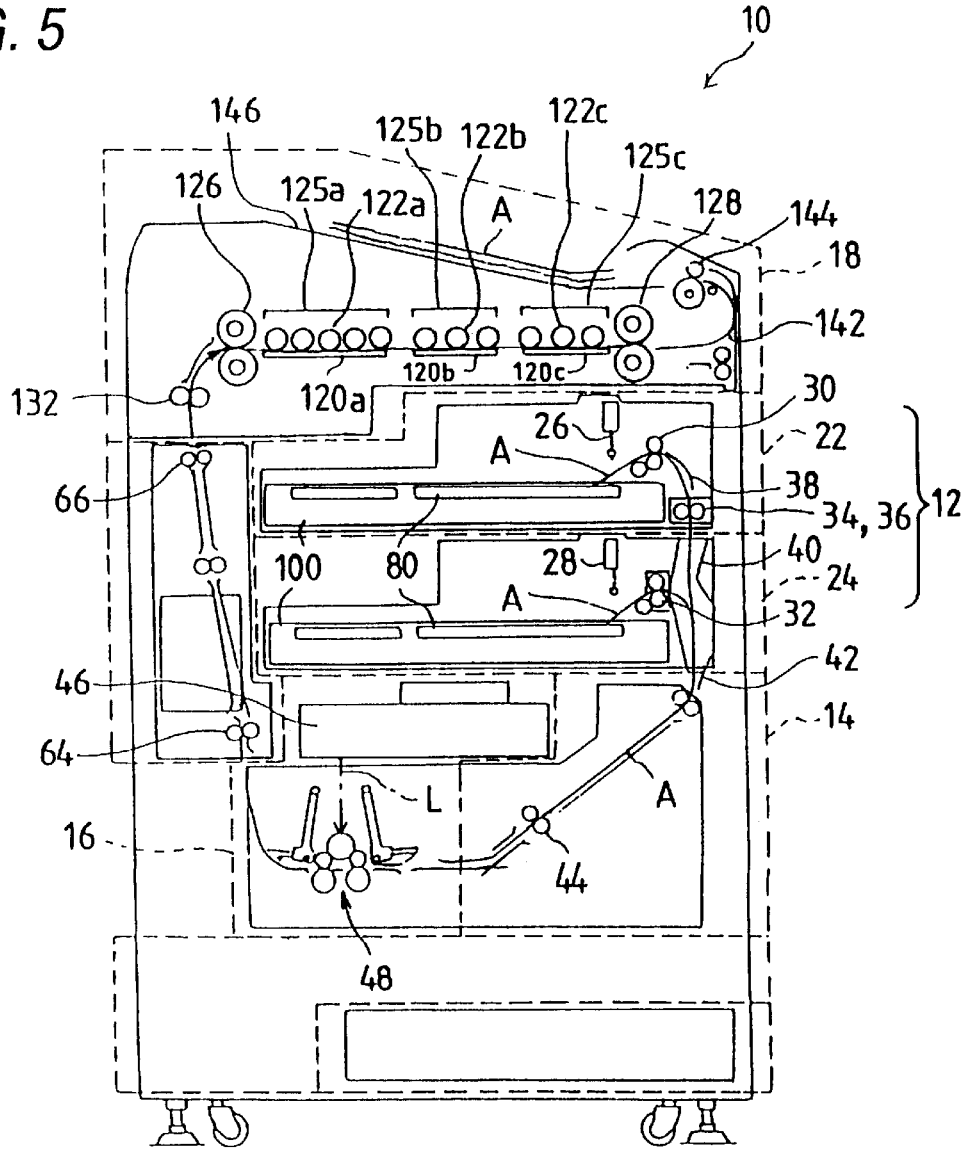
FIG. 5 shows a partially enlarged view showing the plate heater shown in FIG. 1 according to a fourth embodiment of the present invention.
Figure 7:
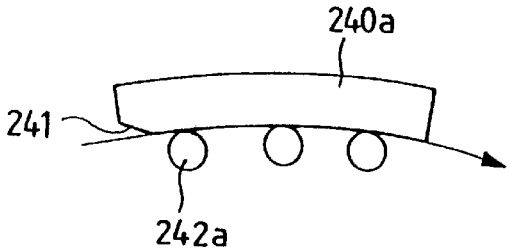
FIG. 7 shows an enlarged view showing a plate heater 240*a*.

FIG. 5 is a schematic view showing the structure of a heat development apparatus according to the fourth embodiment of the present invention, using the heat treatment apparatus as shown in FIG. 1. As shown in FIG. 7, a heat development apparatus 10 is mainly composed of a recording-material supply portion 12, a width aligning portion 14, an image exposing portion 16 and a heat treatment portion 18 disposed in the order of transference of a heat-development photosensitive material or a photosensitive and thermosensitive recording material (hereinafter called "sheet A").

Although the heat development apparatus 10 uses the heat treatment apparatus as shown in FIG. 1, any one of the heat treatment apparatus as shown in FIGS. 1–4 can be used.

The recording-material supply portion 12 extracts each sheet A to supply the sheet A to the width aligning portion 14 disposed downstream in the direction in which the sheet A is transferred. The recording-material supply portion 12 incorporates a recording-material supply means, which has loading portions 22 and 24 and suction cups 26 and 28 provided for the loading portions; paired supply rollers 30 and 32; paired transferring rollers 34 and 36 and transferring guides 38, 40 and 42.

The loading portions 22 and 24 are portions for loading a magazine 100 accommodating sheets A to a predetermined position. In the shown example, the two loading portions 22 and 24 are provided. Magazines 100 for accommodating sheets A which usually have different sizes (for example, a half-cut size for CT or MRI and B4-size for FCR (Fuji Computed Radiography)) are loaded into the two loading portions.

The recording-material supply means provided for each of the loading portions 22 and 24 incorporates suction cups 26 and 28 to suck and hold the sheet A. Moreover, the suction cups 26 and 28 are moved by a known moving means, such as a link mechanism, so that the sheet A is transferred. Thus, the sheet A is supplied to the paired supply rollers 30 and 32 provided for the loading portions 22 and 24.

The sheet A includes the heat-development photosensitive material and the photosensitive and thermosensitive recording material.

The heat-development photosensitive material is a recording material with which an image is recorded (exposed) with at least one optical beam, such as a laser beam, after which heat development is performed to develop color.

The photosensitive and thermosensitive recording material is a recording material with which an image is recorded (exposed) with at least one optical beam, such as a laser beam, after which heat development is performed to develop color. As an alternative to this, a heat mode (heat) or a thermal mode of a laser beam is used to record an image and simultaneously develop color, after which light irradiation is performed to fix the image.

The sheet A is processed into a sheet shape. Moreover, a laminate (a bundle) in a predetermined unit including 100 sheets or the like is formed which is then packaged with a bag or a band so that a package 80 is obtained.

The heat-development photosensitive material and the photosensitive and thermosensitive recording material will be described later.

The sheet A in the loading portion 22 supplied to the paired supply rollers 30 is transferred to the downstream width aligning portion 14 by the paired transferring rollers 34 and 36 while the sheet A is being guided by the transferring guides 38 and 40. On the other hand, the sheet A in the loading portion supplied to the paired rollers 32 is transferred to the downstream width aligning portion 14 by the paired rollers 34, 36 while the sheet A is being guided by transferring guides 40 and 42.

The width aligning portion 14 aligns the sheet A in a direction (herein-after called a "widthwise direction") perpendicular to the transferring direction. Thus, the width aligning portion 14 performs alignment of the sheet A in the downstream image exposing portion 16 in the main scanning direction, that is, so-called side resist. Thus, the paired transferring rollers 44 are rotated to transfer the sheet A to the downstream image exposing portion 16.

The method of performing the side resist in the width aligning portion 14 is not limited. For example, a method may be employed which uses a resist plate which makes contact with either widthwise directional end of the sheet A and a pushing means for pushing the sheet A in the widthwise direction to make contact the end surface with the resist plate. Another method may be employed which uses the Regis plate and a guide plate or the like which restrains the widthwise end of the sheet A in the transferring direction to make contact the sheet A with the resist plate and which is moveable according to the widthwise directional size of the sheet A. Thus, any one of the various known methods may be employed.

The sheet A transferred to the width aligning portion 14 is aligned in a direction perpendicular to the transferring direction as described above, and then transferred to the downstream image exposing portion 16 by the paired transferring rollers 44.

The image exposing portion 16 is a portion for performing scanning and exposure using a light beam to expose the sheet A to correspond to the image. The image exposing portion 16 incorporates an exposing unit 46 and a sub-scanning transferring means 48.

The exposing unit 46 is a known light-beam scanning unit which deflects a light beam L, which has been modulated in accordance with an image, which must be recorded, to the main scanning direction (the widthwise direction of the sheet A) to cause the light beam L to be made incident on a predetermined recording position. The exposing unit, as necessary, is provided with various elements, such as a collimator lens, a beam expander, an image falling correction optical system and an optical-path adjustment mirror, which shape light beam L emitted from the light source and which is provided for a known light beam scanning unit.

The light beam L, the pulse width of which has been modulated in accordance with an image which must be recorded, has been deflected in the main scanning direction. Therefore, the sheet A is, by the light beam, two-dimensionally scanned and exposed so that a latent image is recorded.

The present invention is structured to perform the pulse-width modulation by directly modulating the light source. The present invention may be applied to another unit that performs pulse-number modulation. The present invention may be applied to an indirect modulation unit that incorporates an external modulator, such as an AOM (Acoustic Optical Modulator) if the unit performs the pulse modulation.

The process for recording an image may be performed by analog intensity modulation.

After the latent image has been formed on the sheet A by the image exposing portion 16, the transferring rollers 64 and 66 transfer the sheet A to the heat treatment portion 18. At this time, dust on the right and reverse sides of the sheet A is removed by a dust removing roller 132.

As described above, the heat treatment portion 18 uses the heat treatment apparatus according to the first embodiment.

The heat treatment portion 18 is structured as described above. Moreover, it is preferable that the sheet A is previously heated at a temperature not higher than the development temperature prior to transference of the sheet A to the heat treatment portion 18. As a result, irregular development can furthermore be prevented.

The sheet A discharged from the heat treatment portion 18 is, by paired discharge rollers 128, guided to a guide plate 142, and then accumulated from paired rollers 144 to a tray 146.

Further electric source portion 55 for driving each portion above described, and control portion 50 are formed.

Since the heat treatment portion 18 uses a high heating temperature, power consumption during a usual operation must be minimized. Therefore, it is preferable that control is performed such that a comparison is made between the set temperature and the present temperature to energize one or more heaters within a permitted electric power in a descending order of the difference in the temperature.

To raise the processing speed, the heat treatment portion 18 must as well, shorten the starting time. To realize this, it is preferable that the ratio of the electric capacity of each means for heating each of the plate heaters 120*a,* 120*b* and 120*c* and the thermal capacity of the corresponding plate heaters 120*a,* 120*b* and 120*c* is constant.

Figure 6:
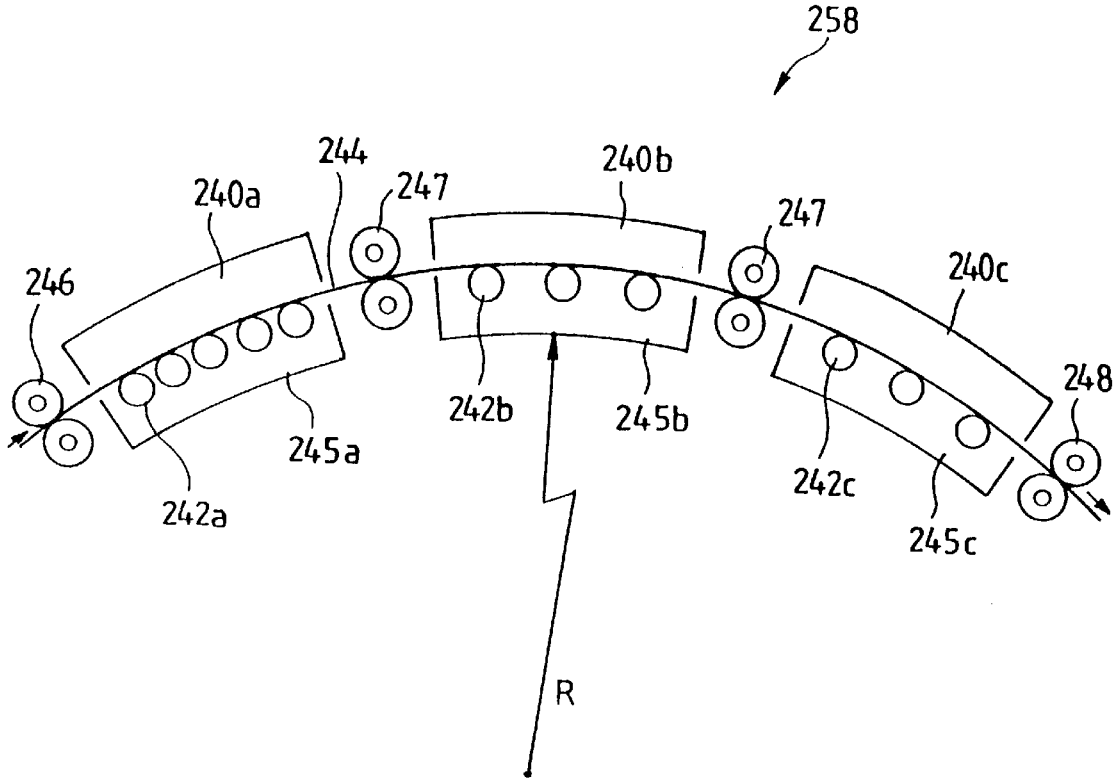
FIG. 6 shows a schematic view showing a heat development apparatus using the heat treatment apparatus according to the fifth embodiment of the present invention.

FIG. 6 is a schematic view showing a heat treatment apparatus according to a fifth embodiment of the present invention. Referring to FIG. 6, this embodiment has a structure such that plate heaters 240*a,* 240*b* and 240*c* are warped. The plate heaters 240*a,* 240*b* and 240*c* and rollers 242*a,* 242*b* and 242*c* are disposed to form a continuous circular arc shape.

Specifically, a heat treatment apparatus 258 incorporates the plate heaters 240*a,* 240*b* and 240*c*. Moreover, as shown in the drawing, the heat treatment apparatus 258 has a structure that the plate heaters 240*a,* 240*b* and 240*c* are projected upwards. Moreover, there is provided a roller 246 serving as a transferring means for relatively moving (sliding) the sheet A while the sheet A is being made contact with the surfaces of the plate heaters 240*a,* 240*b* and 240*c*. In addition, there are provided pressing rollers 242*a,* 242*b* and 242*c* disposed on a recessed lower surfaces of the pressing rollers 240 to transmit heat from the plate heaters 240*a,* 240*b* and 240*c* to the sheet A. Thus, the transference is performed such that the leading end of the sheet A, which must be transferred, is pressed against the pressing rollers 240. As a result, buckling of the sheet A can be prevented.

The pressing rollers 242*a,* 242*b* and 242*c* and the plate heaters 240*a,* 240*b* and 240*c* constitute a sheet transferring passage 244. The sheet transferring passage 244 has intervals shorter than the thickness of the sheet A so that a state in which the sheet A can smoothly be held is realized. Thus, buckling of the sheet A can be prevented. Paired supply roller 246 and paired discharge rollers 248 which are sheet transferring means are disposed at the two ends of the sheet transferring passage 244.

In this embodiment, a sub-roller 247 for assisting transference of the sheet is disposed among the plate heaters 240*a,* 240*b* and 240*c* similarly to the structure shown in FIG. 3. The sub-roller may be omitted.

It is preferable that heat insulating covers 245*a,* 245*b* and 245*c* for insulating heat are disposed adjacent to the pressing rollers 242*a,* 242*b* and 242*c* opposite to the plate heaters 240*a,* 240*b* and 240*c*.

FIG. 7 is a partially enlarged view showing the plate heater 240*a*. As shown in FIG. 7, an inclined surface 241 for sliding and guiding the leading end of the sheet A may be disposed at the end of the portion of the plate heater 240*a* for receiving the sheet A in order to prevent clogging of the sheet. The other plate heaters 240*b* and 240*c* may have similar structures.

Figure 8A:
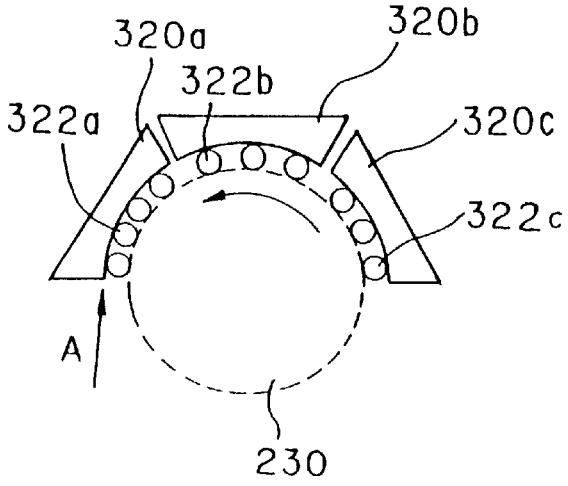
FIG. 8(*a*) shows a schematic view showing a heat treatment apparatus including an example of the rotations of the pressing rollers, FIG. 8(*b*) shows a perspective view showing the shape of the plate heater and FIG. 8(*c*) shows an exploded perspective view showing the heat treatment apparatus shown in FIG. 8(*a*).
Figure 8B:
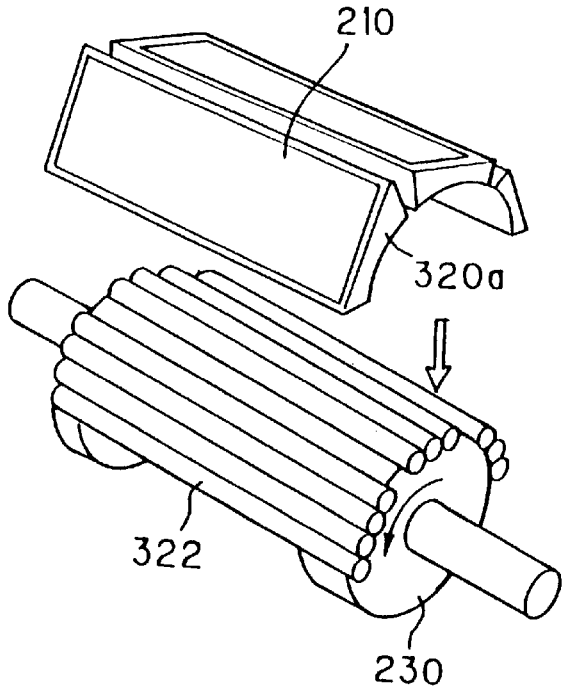
Figure 8C:
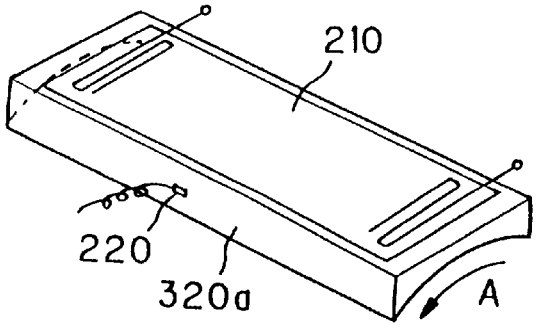

FIGS. 8(*a*) to 8(*c*) show a heat treatment apparatus of the sixth embodiment of the present invention. FIG. 8(*a*) is a schematic view showing a heat treatment apparatus incorporating an example of a state of rotation of the pressing rollers. The rotating roller 230 having the outer surface that is the envelope of each of the pressing rollers 322*a,* 322*b* and 322*c* is disposed to be in contact with each pressing rollers 322*a,* 322*b* and 322*c*. When the rotating roller 230 is rotated, each of the pressing rollers 322*a–c* can be rotated. On the outer side of the pressing rollers 322*a,* 322*b* and 322*c,* the arc-shaped surface constitutes a passage of the sheet A, and on the opposite side of 15 the sheet A with respect to the passage, plate heaters 320*a,* 320*b* and 320*c* are disposed. When the plate heaters 320*a,* 320*b* and 320*c* are made of only a heat conductive material, heating rollers 210*a,* 210*b* and 210*c* may be disposed on the reverse side opposite to the pressing rollers 322*a,* 322*b* and 322*c*. The plate heaters 320*a,* 320*b* and 320*c* may be heating members or may be structured to incorporate plate members composed of a heat conductive material and heat sources disposed opposite to the surfaces of the plate members for heating the sheet A.

FIG. 8(*b*) is an exploded perspective view showing the heat treatment apparatus shown in FIG. 8(*a*). As shown in the drawing, the plate heaters 320*a,* 320*b* and 320*c* are disposed to cover the rotating roller 230 and the pressing rollers 322*a,* 322*b* and 322*c*. Each of the plate heaters 320*a,* 320*b* and 320*c* covers each of the pressing rollers 322*a,* 322*b* and 322*c,* and each of the plate heaters 320*a,* 320*b* and 320*c* are disposed independently.

FIG. 8(*c*) is a perspective view showing states of the plate heaters. The surface of the plate heater 320*a* which makes contact with the sheet is applied with nickel plating. The plate heater 320*a,* which is supplied with electric power from a terminal 220, has a sheet inlet portion that has a large thickness. To easily plate the heater, the surface of the plate heater 320*a* which is made contact with the sheet is made to be a flat surface. The other plate heaters 320*b* and 320*c* have similar structures.

Figure 9:
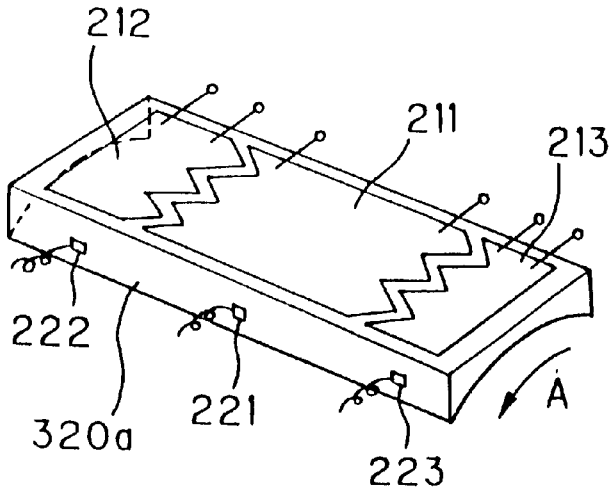
FIG. 9 shows a perspective view showing another embodiment of a plate heater of the heat treatment apparatus shown in FIG. 8(*c*).

FIG. 9 is a perspective view showing another example of the plate heater of the heat treatment apparatus shown in FIG. 8(*c*). The first plate heater 320*a* at the inlet portion for the sheet A is provided with at least three rubber heaters 211, 212 and 213 obtained by dividing the heater 320*a* in the widthwise direction with respect to the direction in which the sheet A is transferred. Thus, the temperature can independently be set for each of the rubber heaters 211, 212 and 213. Electric power density is made to be uniform. Temperature sensors 221, 222 and 223 corresponding to the heaters 211, 212 and 213 are disposed downstream of the plate heater 320*a* provided with the rubber heaters 211, 212 and 213. To prevent an irregular temperature occurring in the boundaries among the heaters, the resistance lines of the adjacent heaters in the widthwise direction are wired in a mutually zigzag manner.

As a result, the distribution of the heating portions of the plate heaters can be made such that the temperature gradient is realized in such a manner that the temperatures at the two end portions are higher than the temperatures at other portions to compensate for lowering of the temperature caused from radiation from the two end portions. Therefore, if sheets having a difference in widths are developed with heat in the same apparatus, deterioration in the distribution of the temperatures can be prevented.

The adjacent portions among the rubber heaters 211, 212 and 213 are formed into engaged states of comb tooth shapes while a predetermined gap is provided among the heaters. As a result, exertion of influences of the gaps, which are non-heating portions, on the sheet A can be prevented. That is, uniform heating can be performed.

Figure 10:
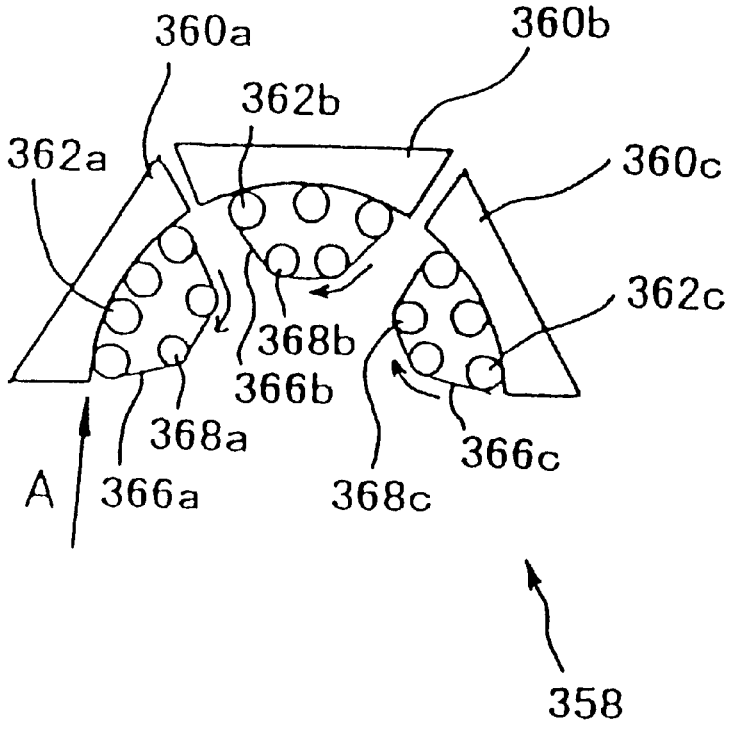
FIG. 10 shows a schematic view showing a driving state of a press roller of the heat treatment apparatus according to the seventh embodiment of the present invention.

FIG. 10 is a schematic view showing an example of the operation of the pressing roller of a heat treatment apparatus according to a seventh embodiment of the present invention. FIG. 10 shows a structure that plate heaters 360*a,* 360*b* and 360*c* having similar structures to those of the plate heaters 320*a,* 320*b* and 320*c* shown in FIG. 8(*a*) have surfaces which make contact with the sheet A and are warped. The foregoing plate heaters 360*a,* 360*b* and 360*c* and the rollers 362*a,* 362*b* and 362*c* are, in a circular-arc configuration, sequentially disposed in this order. Thus, the sheet A is conveyed.

Since the plate heaters 360*a,* 360*b* and 360*c* are similar plate heaters, only one plate heater 360*a* will now be described. The other plate heaters 360*b* and 360*c* have similar structures.

The structure of the heat treatment apparatus 358 will furthermore be described. The passage through which the sheet A is conveyed is formed into a circular arc shape having a projecting portion adjacent to each plate heater 360*a*. That is, the plate heaters 360*a* have a shape formed into a concave shape that constitutes the surface for conveying the sheet A. An endless conveying belt 366*a* is, by a tension roller 368*a,* arranged between the pressing rollers 362*a* which are urged toward the concave surface of the plate heater 360*a* for conveying the sheet A. At the position of the pressing roller 362*a,* the sheet A is held between the plate heater 360*a* and the conveying belt 366*a*. Then, for example, the tension roller 368*a* is rotated to rotate the conveying belt 366*a* so as to convey the sheet A.

The conveying belt 366*a* has a coefficient of friction with respect to the sheet A, the coefficient of friction being higher than the coefficient of friction of the surface of the plate heater 360*a* with respect to the sheet A. Therefore, the sheet A can relatively be conveyed (slid) while the sheet A is in contact with the plate heater 360*a* so as to reliably be conveyed. Therefore, the conveyance 366*a* makes contact with the overall surface of the sheet A. Thus, non-uniform distribution of the pressure which is applied to the sheet A can be prevented. Thus, non-uniform heating can be prevented.

As a means for rotating the conveying belts 366*a–c,* a rotating rollers 230 as shown in FIG. 8(*a*) may be employed to transmit the rotating force to the pressing roller 362*a–c*.

The surface of the conveying belts 366*a–c* opposite to the sheet A may be raised into a brush-like shape. In the foregoing case, the conveying performance can furthermore be improved. When the conveying belts 366*a–c* have gas permeability, gas produced owing to chemical change in the heat treatment layer of the surface of the sheet A can be discharged. As a result, the adhesiveness between the sheet A and plate heater can be improved.

Figure 11:
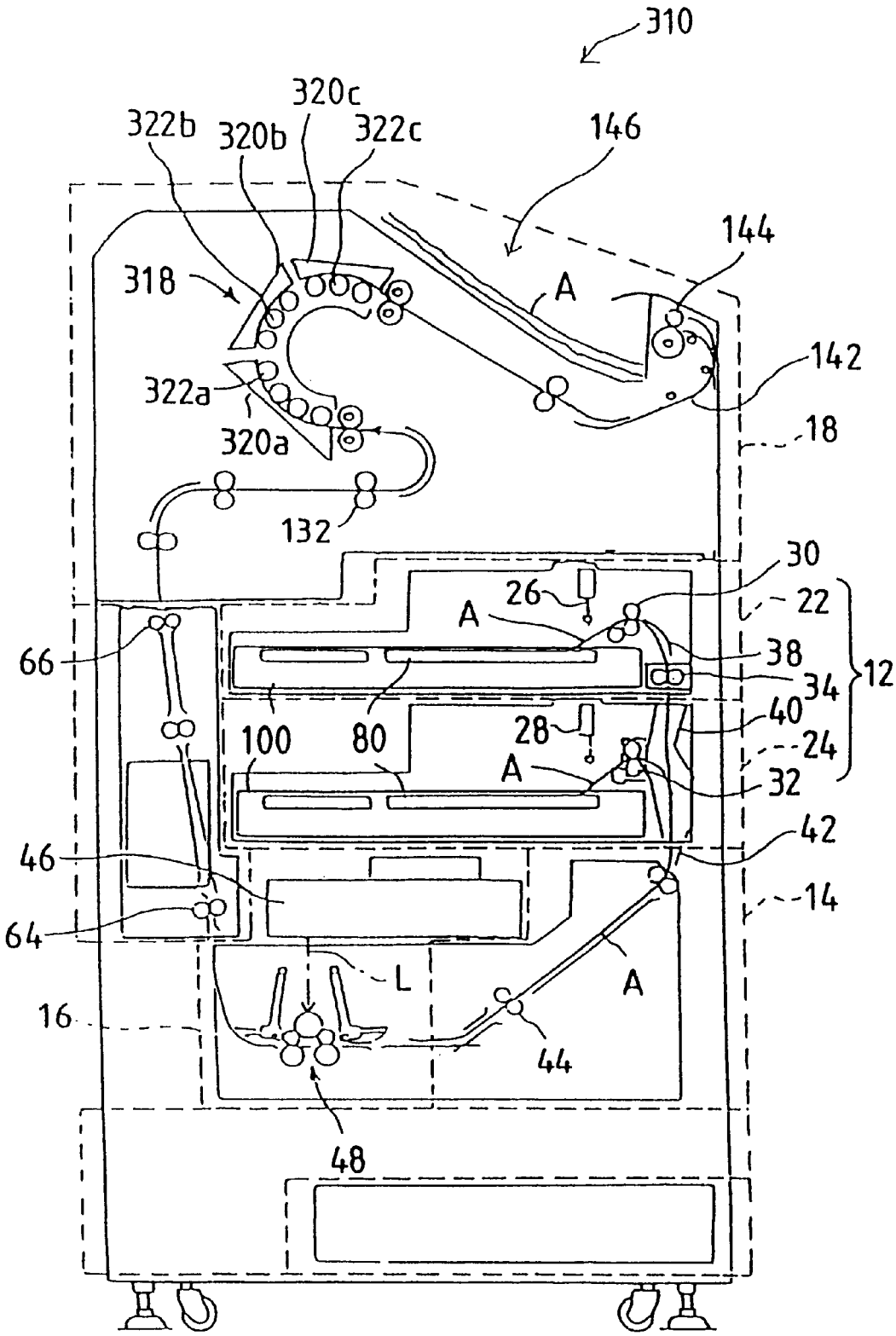
FIG. 11 shows a schematic view showing a heat development apparatus using the heat treatment apparatus according to the eight embodiment of the present invention shown in FIG. 8.

FIG. 11 is a schematic view showing the structure of a heat development apparatus using the heat treatment apparatus according to the eighth embodiment of the present invention. As shown in FIG. 8, a heat development apparatus 310 mainly composed of a recording-material supply portion 12, a width aligning portion 14, an image exposing portion 16 and a heat treatment apparatus 318 disposed in an order of transference of a heat-development photosensitive material or a photosensitive and thermosensitive recording material (hereinafter called "sheet A").

This embodiment is different from the heat development apparatus according to the embodiment shown in FIG. 5 in that the heat treatment apparatus is a warped-type heat treatment apparatus 318. The other structures except for the heat treatment apparatus are similar to those of the heat development apparatus according to the fourth embodiment. Therefore, the structures and the operations are omitted from description.

The heat treatment apparatus 318 according to this embodiment is structured as shown in FIG. 6.

As described above, the sheet A is the heat-development photosensitive material or the photosensitive and thermosensitive recording material. When the heat treatment of each of the materials is performed, each material has a temperature at which the development is started. An actual development process is started at a temperature that is substantially higher than the foregoing temperature.

Therefore, it is preferable that quickest raising of the temperature to the temperature at which the development is started, is performed. If the transference is performed such that the temperature is raised to the development start temperature at about the end of the heating process which is performed by the plate heater 320*a*, the heating temperature remains at about the development start temperature or slightly lowers until the sheet A is moved to the next plate heater 320*b*. Therefore, the transferring pressure somewhat disperses. As a result, the time at which the development is started scatters at each position of the sheet, causing an adverse influence to be exerted on an image (irregular density to occur).

Therefore, transference is set such that the temperature is not raised to the development start level at the first plate heater 320*a*. Moreover, the temperature is raised to the development start level at the next plate heater 320*b*. Thus, the progress of the development can furthermore accurately be controlled.

At this time, it is preferable that the temperature of the sheet is lower than the development start level at the first gap between the heaters; more preferably, the temperature satisfies a range from a level higher than room temperature +40° C. and lower than the development start level −1° C. Although the foregoing method encounters a somewhat elongated development time, the irregular heat development can furthermore be prevented.

Figure 12:
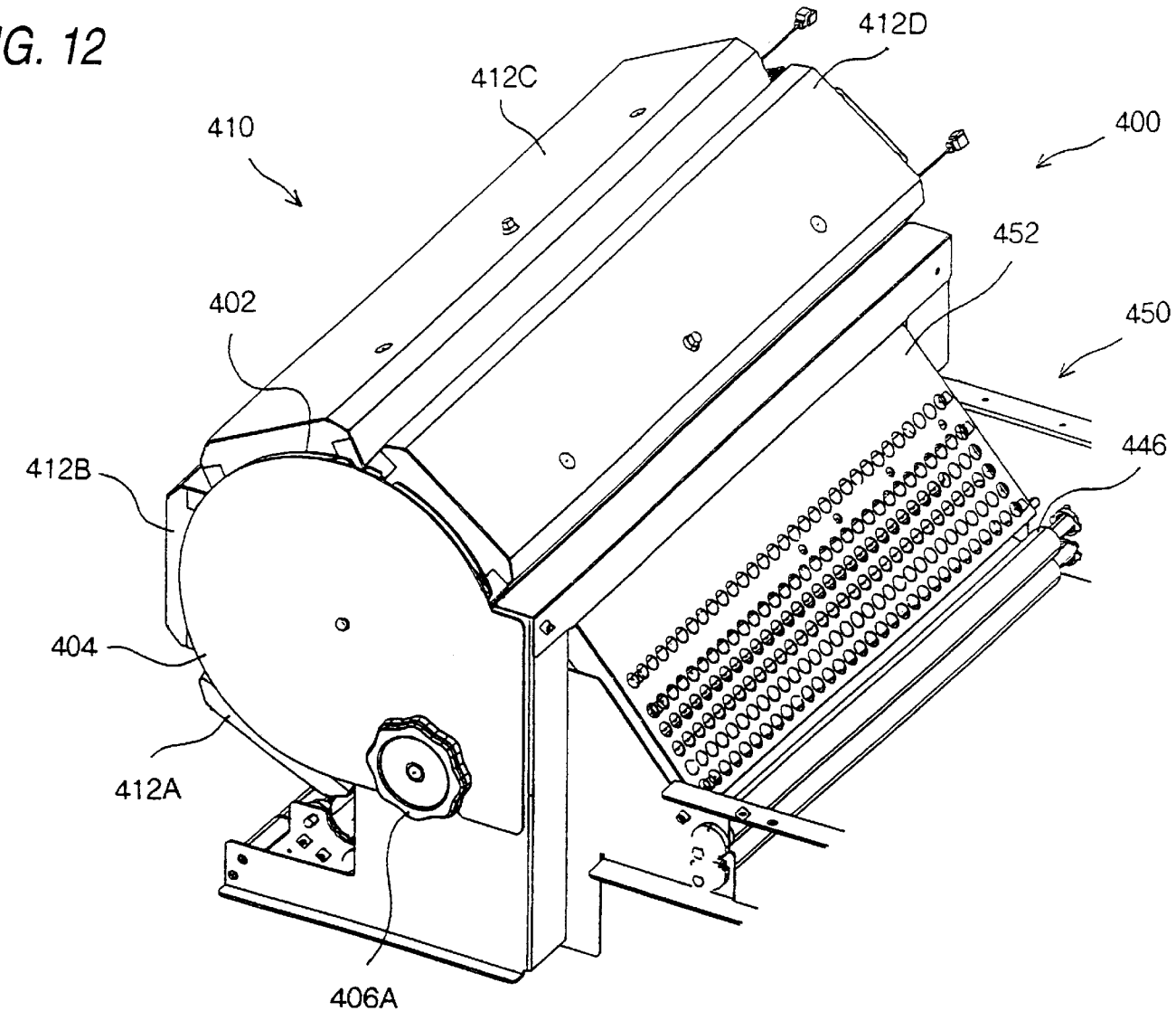
FIG. 12 shows a perspective view showing the shape of a heat treatment apparatus according to a ninth embodiment for use in the heat development apparatus.

A heat treatment apparatus according to a ninth embodiment of the present invention and a heat development apparatus according to the tenth embodiment using the ninth embodiment will now be described with reference to the drawings. FIG. 12 is a perspective view showing the shape of the heat treatment apparatus according to the ninth embodiment of the present invention.

A heat treatment apparatus 400 is divided into a heat treatment portion 410 and a cooling portion 450. A pair of outer covers 404 are secured to a frame 402 of the heat treatment portion 410 at positions corresponding to the two side ends of the sheet A which must be transferred. Moreover, heating-member covers 412A, 412B, 412C and 412D are disposed among the paired covers 404 at the outermost portions of the heat treatment portion 410. The outer covers 404 and the heating-member covers 412A, 412B, 412C and 412D protect the internal elements (to be described later) of a heating unit (to be described later) and the heat treatment portion 410 and insulate heat of the internal elements. The surface of each of the heating-member covers 412A, 412B, 412C and 412D may be provided with filling to protect an operator or the like from burns from the touch. The material of the filling must be hair-like material having heat resistance at about 150° C., the material being, for example, 6-nylon or 66-nylon. Moreover, the cooling portion 450 is connected to the downstream portion of the heat treatment portion 410. Moreover, a cover 452 is disposed to maintain heat insulation and safety.

Figure 13:
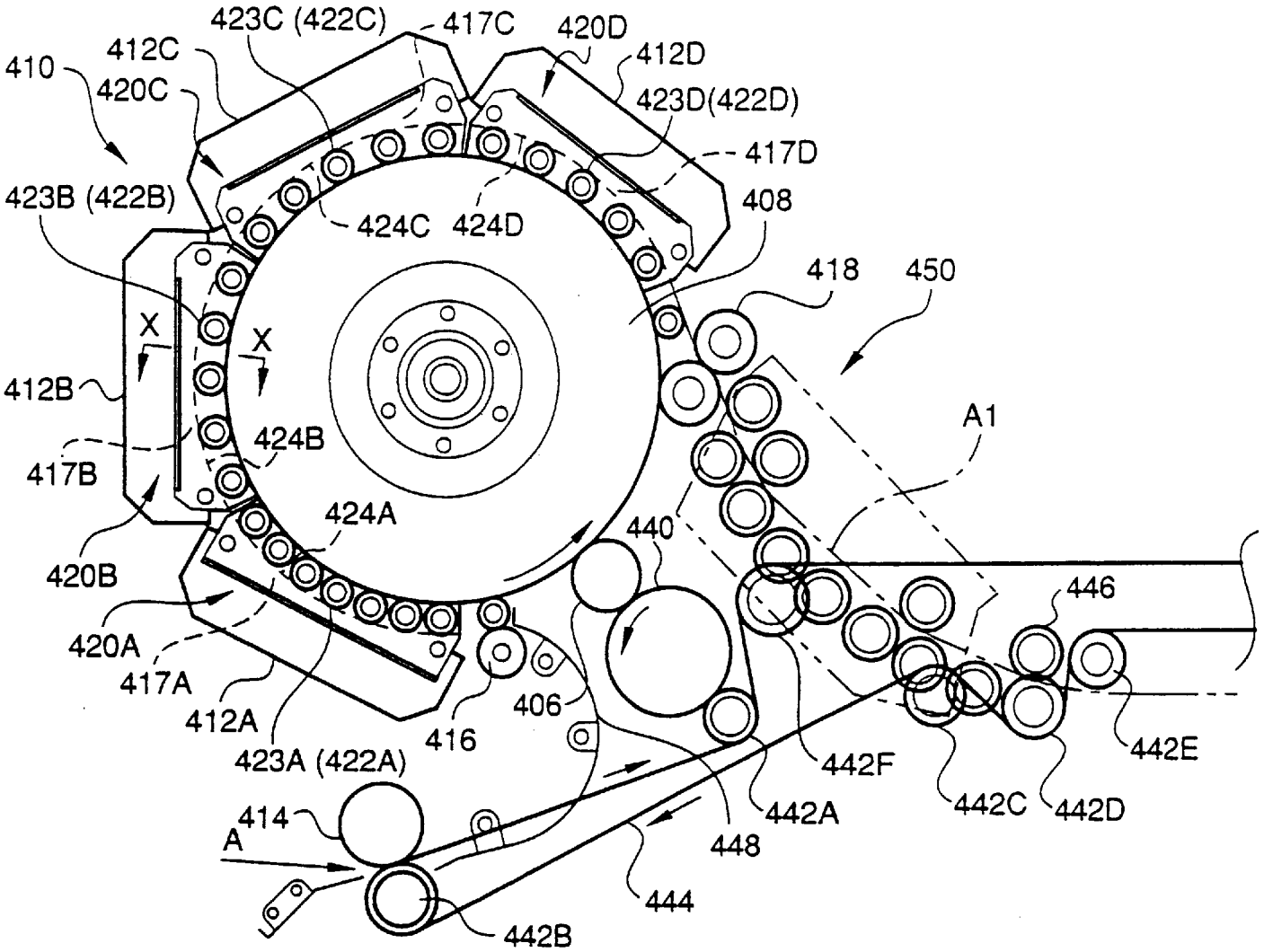
FIG. 13 shows a schematic view showing the internal structure of the heat treatment apparatus shown in FIG. 12 and a transferring passage.

FIG. 13 is a schematic view showing the internal structure and a transferring passage of the heat treatment apparatus shown in FIG. 12. The heating and transferring structures in the heat treatment portion 410 are substantially the same as those of the heat treatment apparatus shown in FIG. 6. That is, heating units 420A, 420B, 420C and 420D provided with plate heaters 417A, 417B, 417C and 417D having warped surfaces 424A, 424B, 424C and 424D are sequentially disposed under the heating-member covers 412A, 412B, 412C and 412D from upstream positions. The heating units 420A, 420B, 420C and 420D are, along the warped surfaces 424A, 424B, 424C and 424D, provided with a plurality of pressing rollers 422A, 422B, 422C and 422D. Thus, the overall body is formed into a sequential circular-arc shape.

Follower gears 423A, 423B, 423C and 423D are disposed at the axial-directional ends of the pressing rollers 422A, 422B, 422C and 422D. A pressing-roller drive gear 408 is borne by the frame 402 at a position at which the pressing-roller drive gear 408 is engaged to the pressing rollers 422A, 422B, 422C and 422D such that the axis of the pressing-roller drive gear 408 is the center of the circular-arc configuration of the pressing rollers 422A, 422B, 422C and 422D. The pressing-roller drive gear 408 is, through a follower gear 406, rotated by a main drive gear 440 which is, below the heat treatment portion 410, supported by the frame 402.

Paired supply rollers 416 are disposed upstream of the heating unit 420A to reliably transfer the sheet A into the heat treatment portion 410. The pressing-roller drive gear 408 may be structured to also rotate the paired supply rollers 416.

Since the pressing-roller drive gear 408 rotates the paired supply rollers 416 and the pressing rollers 422A, 422B, 422C and 422D, the transference of the sheet A, which is being heated, can smoothly be performed.

When the thermal conductivity of the pressing-roller drive gear 408 is high, great heat radiation from the heat treatment portion 410 occurs. Therefore, it is preferable that a material, such as a resin material (for example, a Bakelite plate), having a large thermal capacity is employed. The tooth portions may be made of metal or glass fiber from a viewpoint of obtaining satisfactory durability.

The main drive gear 440 transmits rotational force to a drive-force transmission gear 442A and transmits drive force to a drive belt 444 arranged among drive-force transmission gears 442B, 442C, 442D, 442E and 442F. Thus, transferring rollers and a delivery roller 446 of a sheet introduction roller 414 and the cooling portion 450 are rotated. Note that individual drive sources may be employed.

Paired heat-treatment-portion discharge rollers 418 are disposed at downstream positions of a heating unit 420D. The cooling portion 450 is disposed adjacent to the paired heat-treatment-portion discharge rollers 418. The sheet A is transferred through a sheet transferring passage A1 in the cooling portion 450. Then, a discharge roller 418 discharges the sheet A, the temperature of which has been lowered to a level not higher than the development proceeding temperature.

When the heat treatment portion 410 is on standby, the rotative portions are rotated slowly to prevent heat deviation of among the portions.

The power supply voltage that is applied to the heating unit may be monitored to calculate the heating value so as to adjust the power supply voltage or energization/de-energization so that the overall heating value is controlled.

Figure 14:
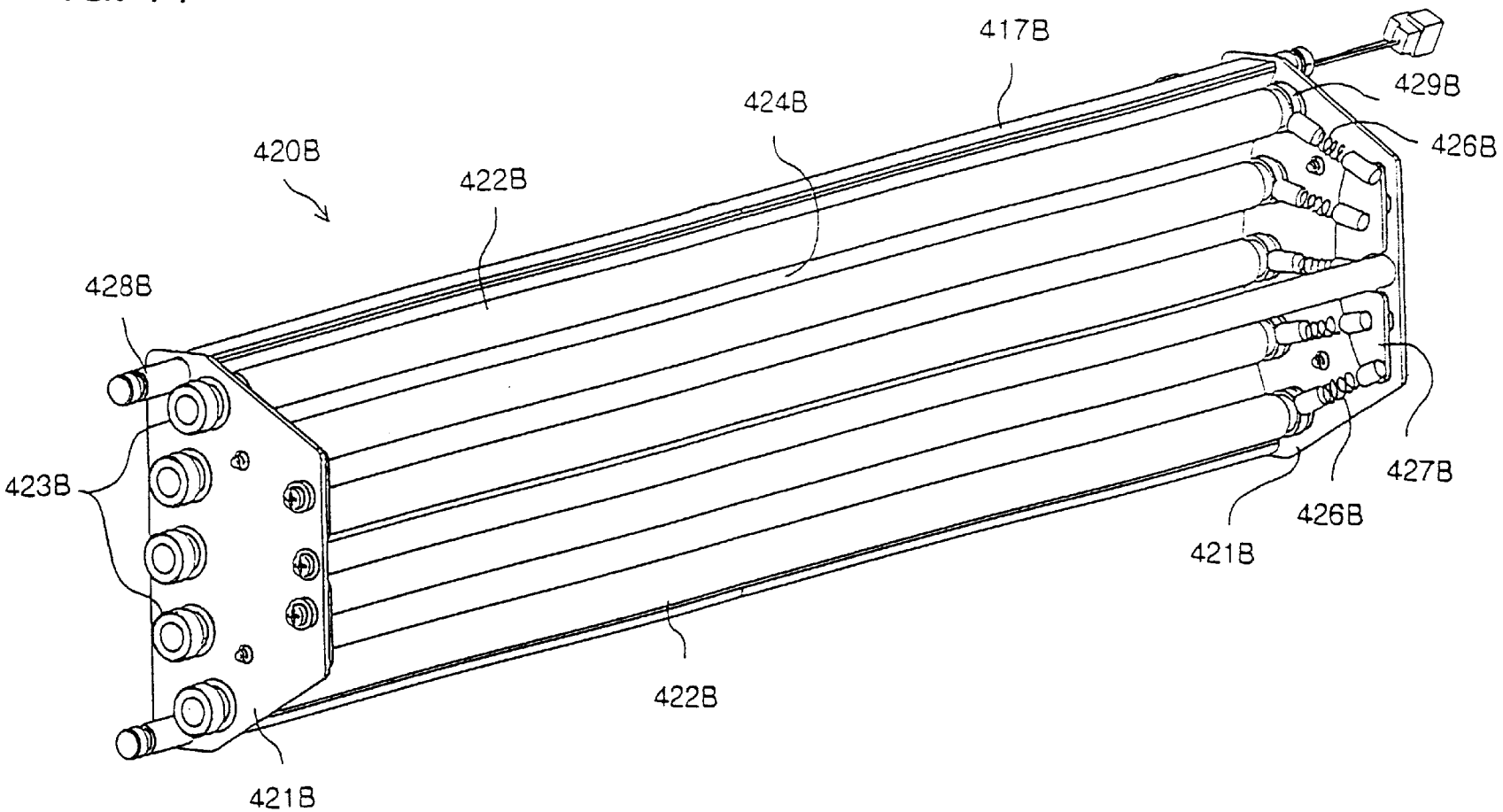
FIG. 14 shows a perspective view showing the structure of a heating unit 420B of the heat treatment apparatus shown in FIG. 12.

FIG. 14 is a perspective view showing the structure of the heating unit 420B of the heating units of the heat treatment apparatus shown in FIG. 12. Since the structures of the heating units 420A, 420B, 420C and 420D are substantially the same, the structure of only the heating unit 420B will now be described.

As shown in the drawing, the plate heater 417B and each pressing roller 422B are held between paired heating-member side plates 421B. A follower gear 423B disposed at an axial-directional end of the pressing roller 422B is disposed on the outside of a heating-member side plate 421B. Support pins 428B for securing the heating unit 420B to the frame 402 are, in a portion in which the follower gear 423B is disposed, provided for each heating-member side plate 421B. The pressing roller 422B is, adjacent to the plate heater 417B, supported by a bearing 429B to be rotative with respect to the heating-member side plate 421B. The bearing 429B is urged by an urging member 426B supported by the heating-member side plate 421B with a holding member 427B toward a warped surface 424B of the plate heater 417B. Although the holding member 427B is secured to the heating-member side plate 421B with screws in the drawing, welding or an adhesive agent may be employed.

The material of each of the pressing rollers 422A, 422B, 422C and 422D is silicon to realize satisfactory transferring easiness and heat insulating characteristic. Grease of the bearing 429B has heat resistance of about 150° C.

Figure 15:
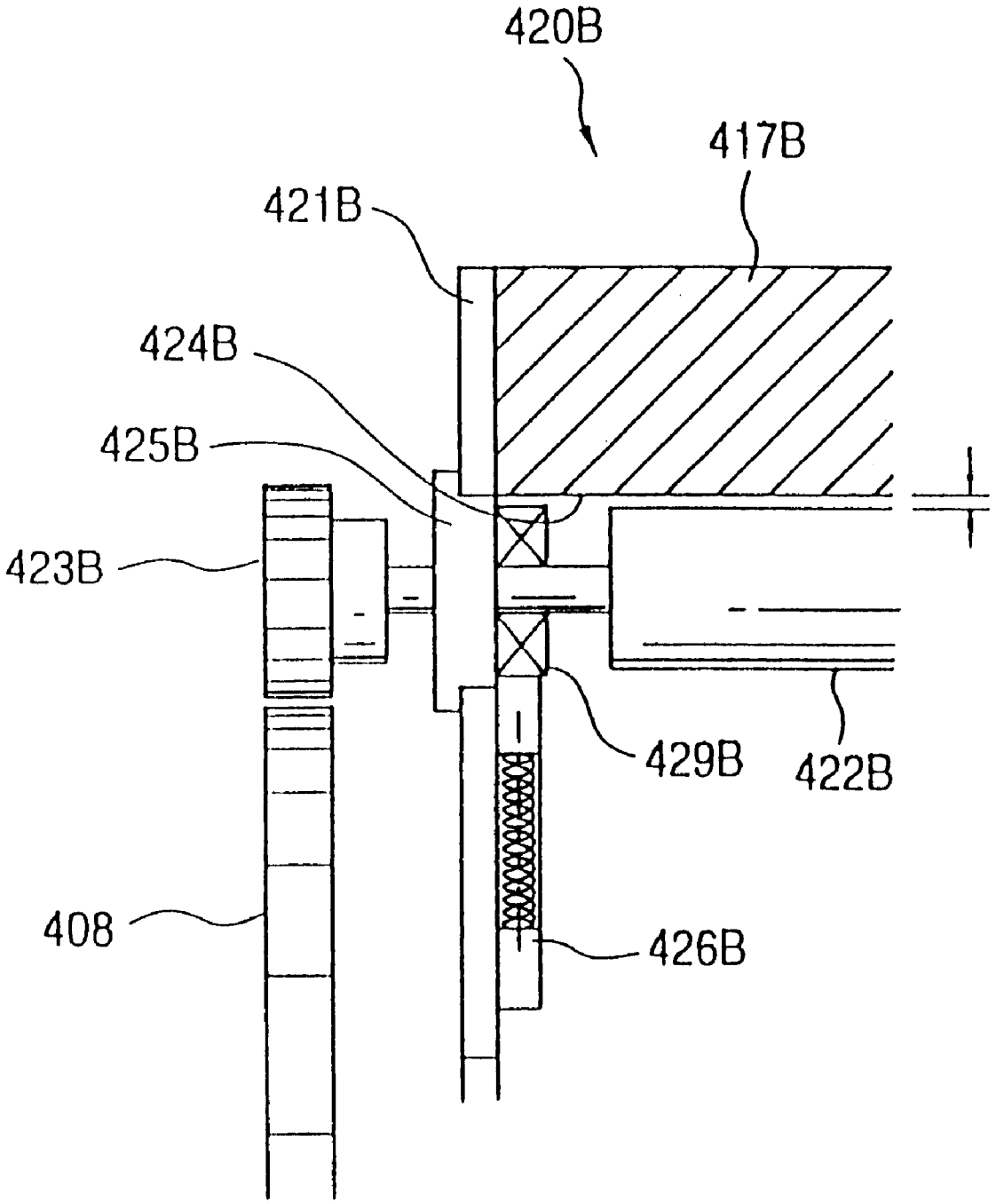
FIG. 15 shows a diagram showing the heat treatment apparatus shown in FIG. 13 taken along line X—X.

FIG. 15 is diagram showing the heat treatment apparatus shown in FIG. 13 and taken along line X—X.

As shown in FIG. 13, the pressing roller 422B is rotatively supported by a bearing 429B of a support member 425B secured by the heating-member side plate 421B. The structure formed by the support member 425B and the bearing 429B permits the shaft of the pressing roller 422B to be moved in a direction toward the plate heater 417B for a predetermined distance. When the sheet A has been transferred to a position between the pressing roller 422B and the plate heater 417B, the foregoing gap is enlarged. Since the bearing 429B is urged toward the plate heater 417B by the urging member 426B, the sheet A is applied with a required pressure so as to be brought into contact with the plate heater 417B without any gap.

In a state in which the sheet A is not introduced, the pressing-roller drive gear 408 and the follower gear 423B are positioned closely without any engagement with each other. After the sheet A has been introduced, the gap between the pressing roller 422B and the plate heater 417B is enlarged as described above. In this case, the follower gear 423B is engaged on a pitch circle of the pressing-roller drive gear 408. As a result of the abovementioned arrangement, the pressing rollers that are not holding the sheet A are not rotated. Thus, a load required to rotate the pressing-roller drive gear 408 can be reduced.

The gap between the pressing roller 422B and the plate heater 417B which is maintained in a state in which the sheet A is not introduced is set to be somewhat shorter than the thickness of the sheet A. If the thickness of the sheet A is 0.2 mm, an appropriate gap is about 0.15 mm. In the foregoing case, it is preferable that the distance for which the shaft of the pressing roller 422B can be moved is about 0.05 mm to 0.65 mm. Since the difference between the diameter of the pressing roller 422B and that of the bearing 429B is constant, the foregoing fact is used to improve the accuracy of the gap between the pressing roller 422B and the plate heater 417B.

The heater portion of the plate heater 417B is structured such that a metal plate opposite to the pressing roller 422B is provided and a silicon rubber heater in a layered structure interposing a heating-wire pattern is bonded to the reverse side opposite to the pressing roller 422B. In the bonding process, the metal plate and the silicon rubber heater, which has not been vulcanized, are integrally molded with each other. Thus, vulcanization of the silicon rubber heater and bonding to the metal plate are performed in a stroke. As a result of the foregoing process, the silicon rubber heater and the metal plate can be brought into intimate contact with each other without any gap. Therefore, abnormal heating, which causes the silicon rubber to be melted or burnt, owing to introduction of a gap can be prevented.

Figure 16:
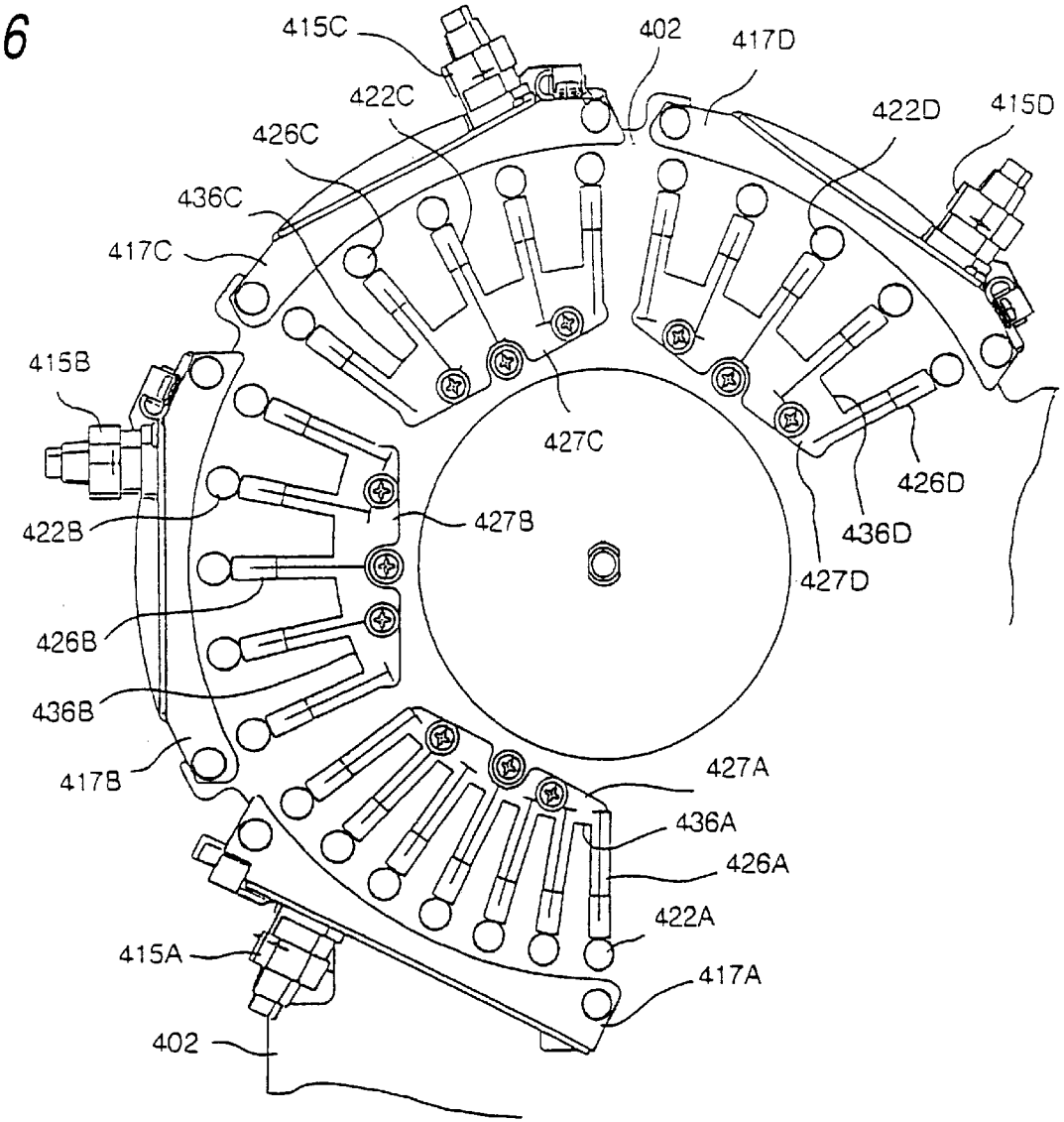
FIG. 16 shows a horizontal cross sectional view showing a portion including the heating unit of the heat treatment apparatus shown in FIG. 12.

FIG. 16 is a horizontal cross sectional view showing a heating unit portion of the heat treatment apparatus shown in FIG. 12.

FIG. 16 shows the connection of pressing rollers 422A, 422B, 422C and 422D among the heating units 420A, 420B, 420C and 420D. As described above, each of the pressing rollers is urged to a predetermined position toward the plate heaters 417A, 417B, 417C and 417D by urging members 426A, 426B, 426C and 426D secured to holding members 427A 427B, 427C and 427D. Each of the urging members 426A, 426B, 426C and 426D is structured to accommodate a spring and arranged to be engaged to a stopper (not shown) provided for each of the holding members 427A, 427B, 427C and 427D. Thus, each pressing roller is urged.

The plate heaters 417A, 417B, 417C and 417D are provided with terminals 415A, 415B, 415C and 415D for supplying electric power.

Inclination of each of the heating units 420A, 420B, 420C and 420D causes influences of the weights of the pressing rollers 422A, 422B, 422C and 422D on the urging members 426A, 426B, 426C and 426D to undesirably be different from one another. To make the pressing force which is exerted on the sheet A to be constant, the urging force of each of the urging members must be changed for each of the heating units. Therefore, the springs in the urging members have the same rate and the positions of the stoppers are varied or the holding members 427A, 427B, 427C and 427D so that required urging force is obtained. In the structure shown in FIG. 14, the stoppers are disposed in cut bottom portions 436A, 436B, 436C and 436D of the holding members 427A, 427B, 427C and 427D. The holding members disposed at different cut bottom portions 436A, 436B, 436C and 436D are employed to adjust the urging force of each of the urging members.

Figure 17:
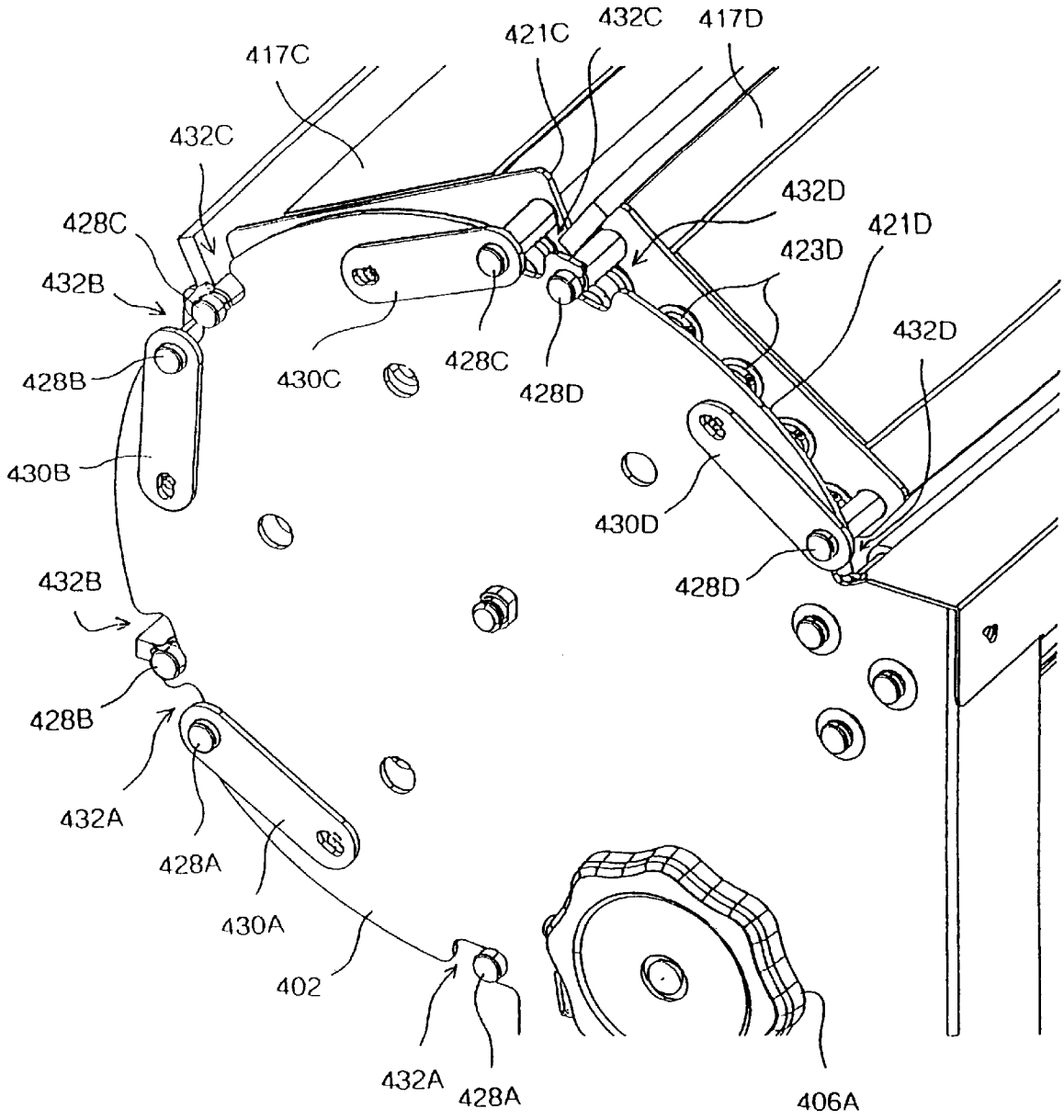
FIG. 17 shows a partial perspective view showing the heat treatment apparatus shown in FIG. 12 in a state in which the outer cover and the heating member cover have been removed.

FIG. 17 is a partial perspective view showing the heat treatment apparatus shown in FIG. 12 in a state in which the outer cover and the heating-member cover have been removed.

Cut portions 432A, 432B, 432C and 432D for holding the heating units are formed at positions on the surface of the frame 402 at which the heating units are disposed. Thus, paired support pins 428A, 428B, 428C and 428D provided for the heating units are received. Fixed plates 430A, 430B, 430C and 430D are joined to either of the paired support pins. Then, the fixed plates 430A, 430B, 430C and 430D are secured to the frame 402 so that the heating units are secured to predetermined positions. In the structure shown in the drawing, each of the fixed plates is secured with one fixing screw. The portions of the support pins 428A, 428B, 428C and 428D which make contact with the frame 402 are made of material having low thermal conductivity. Therefore, undesirable heat radiation from the heating units can be prevented.

As a result, securing and removal of the heating units to the frame can easily be performed.

Note that a handle 406A (see FIG. 12 also) is directly connected to the follower gear 406 to permit the pressing roller to manually be rotated if the sheet A is clogged.

Figure 18:
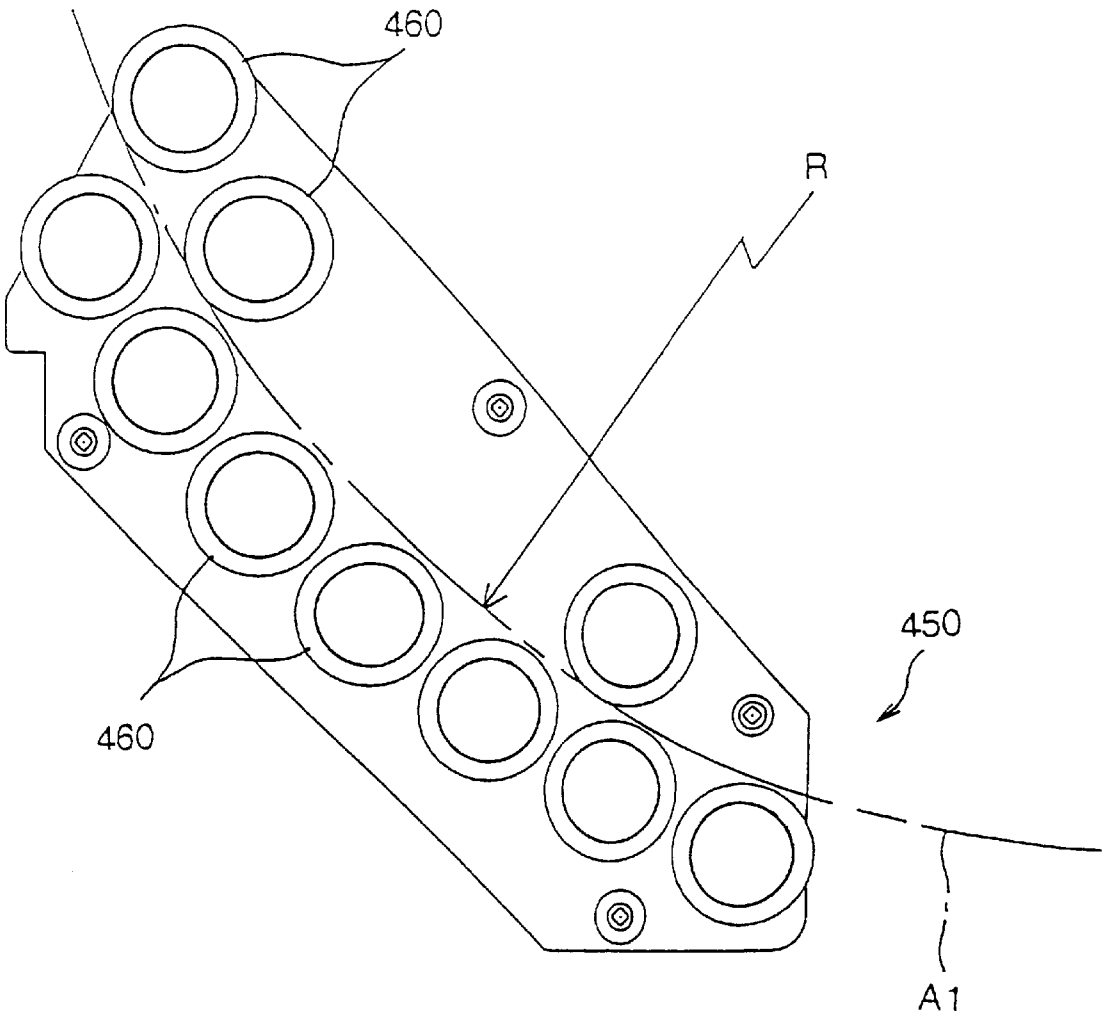
FIG. 18 shows an enlarged view showing the cooling portion of the heat treatment apparatus shown in FIG. 13.

FIG. 18 is an enlarged view showing the cooling portion of the heat treatment apparatus shown in FIG. 13.

Each cooling roller 460 of the cooling portion 450 is disposed to impart a predetermined curvature R to the sheet transferring passage A1 for the sheet A. Thus, the sheet A is transferred with the predetermined curvature R until the sheet A is cooled to a glass transition temperature of the material of the sheet A. Since the curvature is intentionally imparted to the sheet A, formation of an undesirable curl of the sheet A can be prevented before the sheet A is cooled to the glass transition temperature. If the temperature is lowered to a level not higher than glass transition temperature, formation of a new curl can be prevented. Thus, dispersion of the amounts of formed curls can be prevented.

To prevent undesirable change in the density by making the time at which the temperature is lowered to a level not higher than the development proceeding level to be constant, it is preferable that the following process is performed.

That is, the temperature of the internal atmosphere of each of the cooling roller 460 and the cooling portion 450 may be adjusted. The foregoing adjustment of the temperature enables the state immediately after the start of the operation of the heat treatment apparatus and a state realized after a sufficient running operation has been performed to be the same as much as possible. Thus, a change in the density can be reduced.

As can be understood also from FIG. 12, openings are provided for the cooling cover 452 such that the number of the openings is enlarged down-stream. Thus, no control unit is required to perform cooling with an acceptable temperature lowering curve. When the cooling roller 460 in the form of a pipe is employed which has two ends made of a material having low thermal conductivity, the thermal capacity can be reduced. Moreover, the difference in the temperature between the state immediately after the start of the operation of the heat treatment apparatus and a state realized after a sufficient running operation has been performed can be reduced.

Textile felt is spirally wound around the surface of the cooling roller 460. As a result of the foregoing structure, continuous contact of the seam of the felt with the same position of the sheet A is permitted. Therefore, any mark of the seam is not left.

Figure 19:
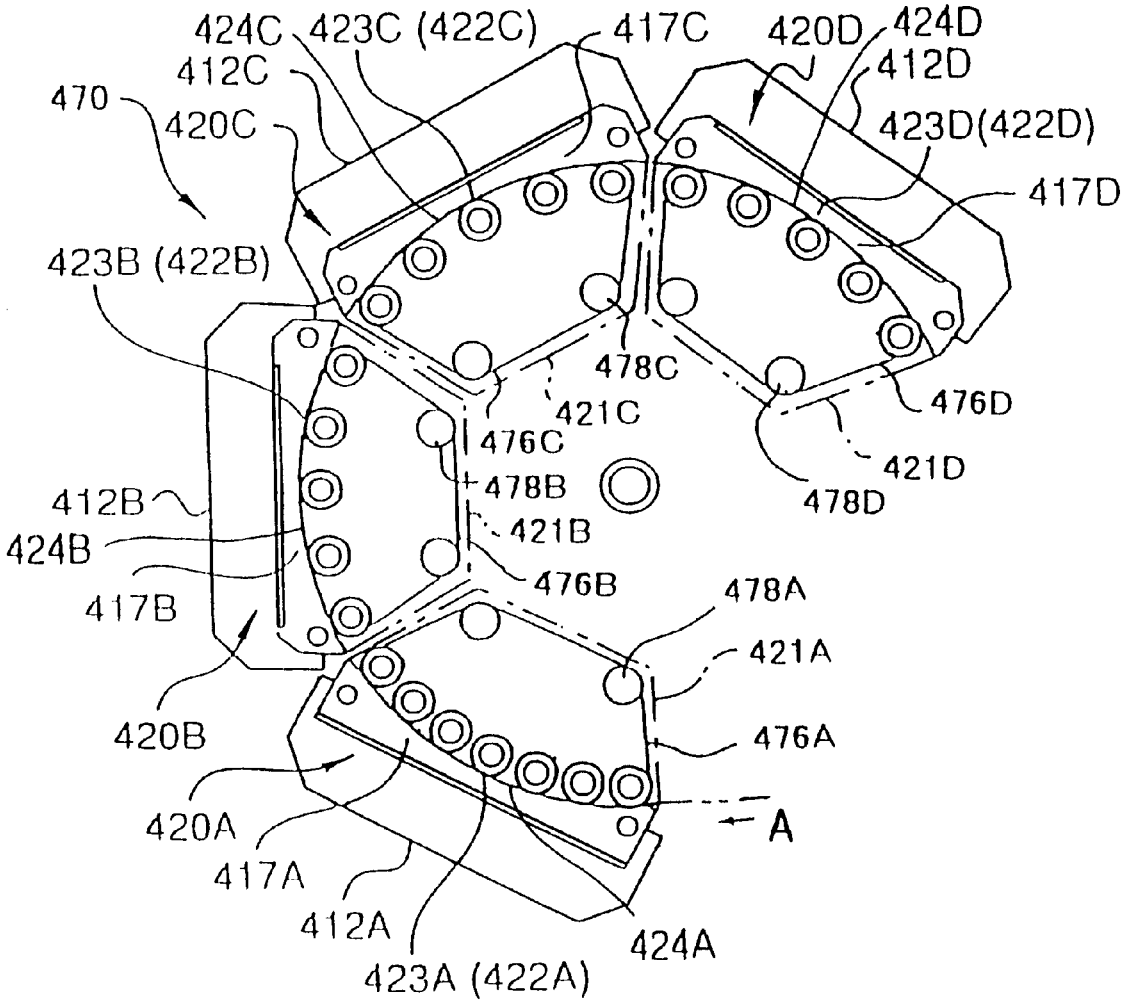
FIG. 19 shows a schematic view showing the internal structure of the heat treatment apparatus shown in FIG. 12 and a transferring passage.

FIG. 19 is a schematic structural view showing the internal structure and the conveying passage of a heat treatment apparatus which is another embodiment of the heat treatment apparatus shown in FIG. 12. The same elements of the heat treatment apparatus 470 as those of the heat treatment apparatus shown in FIG. 13 are given the same reference numeral.

In an inside portion formed by heating-member covers 412A, 412B, 412C and 412D, heating units 420A, 420B, 420C and 420D incorporating plate heaters 417A, 417B, 417C and 417D each having a warped surface are sequentially disposed from an upstream position. Moreover, the heating units 420A, 420B, 420C and 420D are provided with a plurality of pressing rollers 422A, 422B, 422C and 422D which are disposed along the warped surfaces 424A, 424B, 424C and 424D. Thus, the overall shape is formed into a circular-arc configuration.

The heating units 420A, 420B, 420C and 420D are structured such that endless conveying belts 476A, 476B, 476C and 476D arranged among the pressing rollers 422A, 422B, 422C and 422D are disposed among the plate heaters 417A, 417B, 417C and 417D and the pressing rollers 422A, 422B, 422C and 422D. Similarly to the pressing rollers 422A, 422B, 422C and 422D, tension rollers 478A–D supported by the heating-member side plates 421A, 421B, 421C and 421D exert tensions to the endless conveying belts 476A, 476B, 476C and 476D.

As a result of the foregoing structure, the sheet A is held among the plate heaters 417A, 417B, 417C and 417D and the conveying belts 476A, 476B, 476C and 476D at the position of each of the pressing rollers 422A, 422B, 422C and 422D. Then, the conveying belts 476A, 476B, 476C and 476D are rotated to convey the sheet A.

As a rotating system for rotating the conveying belts 476A, 476B, 476C and 476D, a structure similar to that of the heat treatment apparatus shown in FIG. 13 may be employed in which a roller rotating gears 408 rotatively borne by a frame 402 is engaged to follower gears 423A, 423B, 423C and 423D disposed at the axial-directional end of the pressing rollers 422A, 422B, 422C and 422D. Another structure maybe employed in which a gear similar to the roller rotating gear 408 is engaged to the tension rollers 478A–D.

Each of the conveying belts 476A, 476B, 476C and 476D has a coefficient of friction with respect to the sheet A, the coefficient of friction being higher than the coefficient of friction of the surface of each of the plate heaters 417A, 417B, 417C and 417D with respect to the sheet A. Therefore, the sheet A can relatively be moved (slid) so as to reliably be conveyed while the sheet A is being made contact with the surface of each of the plate heaters 417A, 417B, 417C and 417D. Therefore, the conveying belts 476A, 476B, 476C and 476D are brought into contact with the overall surface of the sheet A. Thus, non-uniform distribution of the pressure which is applied to the sheet A can be prevented. As a result, non-uniform heating can be prevented.

The surfaces of the conveying belts 476A, 476B, 476C and 476D opposite to the sheet A may be raised into the brush-like shape. In the foregoing case, conveying performance can furthermore be improved. When the conveying belts 476A, 476B, 476C and 476D have gas permeability, gas produced owing to chemical change in the heat treatment layer of the surface of the sheet A can be discharged. As a result, the adhesiveness between the sheet A and the plate heater can be improved.

Figure 20:
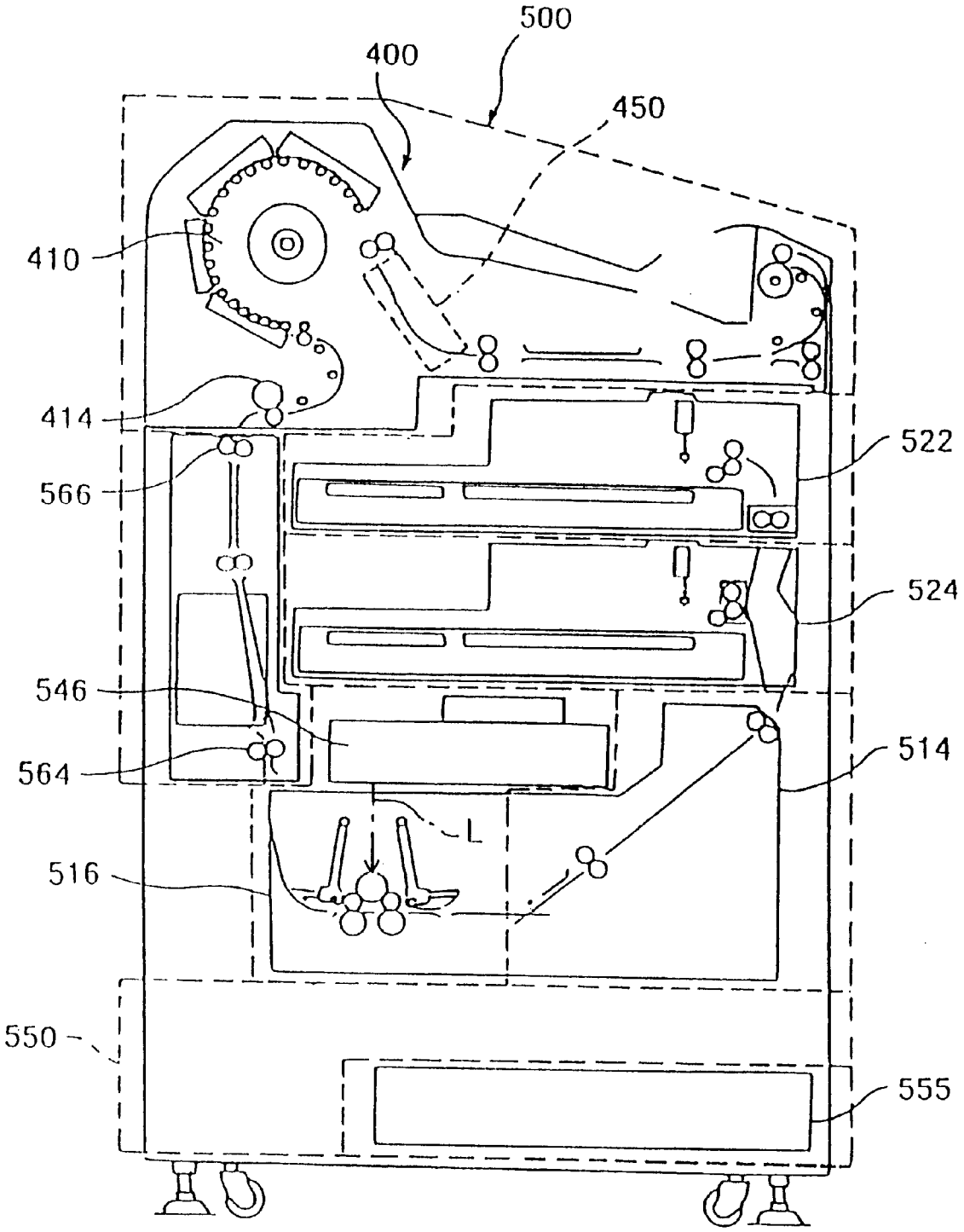
FIG. 20 shows a schematic view showing a heat development apparatus using the heat treatment apparatus according to the tenth embodiment of the present invention shown in FIG. 12.

FIG. 20 is a schematic view showing the structure of a heat development apparatus incorporating the heat treatment apparatus shown in FIG. 12 according to the tenth embodiment of the present invention. Therefore, same as shown in FIG. 11, the heat development apparatus 500 is mainly composed of a recording-material supply portion 522, 524, a width aligning portion 514, an image exposing portion 516 and the heat treatment apparatus 400 disposed in the order of transference of a heat-development photosensitive material or a photosensitive and thermosensitive recording material (hereinafter called "sheet A"). The recording-material supply portion 522, 524 corresponds to the recording-material supply portion 12. The width aligning portion 514 corresponds to the width aligning portion 14. The image exposing portion 516 corresponds to the image exposing portion 16. The heat treatment apparatus 400 corresponds to the heat treatment apparatus 18. The "sheet A" is transferred to the sheet conveying roller 414 of the heat treatment apparatus by means of the conveying rollers 564 and 566, after exposure in the image exposing portion 516. Electric source portion 555 and controlling portion 550 are disposed under the heat development apparatus.

The heat treatment apparatus 400 according to this embodiment is disposed as shown in FIGS. 12 to 18. The other portions except for the heat treatment apparatus are similar to those of the heat development apparatus according to the first embodiment. Therefore, the description of the structures and operations of the same portions are omitted.

EXAMPLE 1

The heat treatment apparatus shown in FIG. 8 was used to make a comparison between a structure in which the plate-like heating member was divided into three sections (the first embodiment) and a structure in which a one-plate heating member was employed (Comparative Example 1).

The heat treatment apparatus shown in FIG. 6 incorporates the plate heaters 320*a*, 320*b* and 320*c* each having surface, which is made contact with the sheet and which is applied with nickel plating. To enlarge the thickness of each of the plate heaters 320*a,* 320*b* and 320*c* in the sheet inlet portions and easily bond the heaters, the reverse side opposite to the surface that is in contact with the sheet is made to be a flat surface. A heater 210 is a rubber heater set to realize a uniform electric power density of 5 kw/m$^2$ without local dispersion.

The temperature of the plate was set to be 120° C. When the temperature was raised to the foregoing level, 20 half-cut sheets A were successively fed at intervals of 8 seconds so as to be subjected to heat treatment.

As can be understood from Table 1, division of the plate enabled the difference in the temperature during the heat treatment to be reduced as compared with the conventional structure. Thus, the quality of the heat treatment was improved.

TABLE 1

| | Comparative Example 1 | Example 1 |
|---|---|---|
| Divided Plates (Sheet Transfer Direction) | Not Divided 450 mm × 1 | Divided into three sections 150 mm × 3 |
| Irregular Temperature Of Half-Cut Sheet (along the surface) | ΔT = 3° C. | ΔT = 1° C. |
| Irregular Temperature Of Half-Cut Sheet (between surfaces) | ΔT = 4° C. | ΔT = 2° C. |

EXAMPLE 2

The heat treatment apparatus shown in FIG. 8 was used to make a comparison between a structure in which the plate-like heating member was divided into three sections (the first embodiment) and a structure in which a one-plate heating member was employed (Comparative Example 1).

The temperature of the plate was set to be 120° C. When the temperature was raised to the foregoing level, 20 half-cut sheets A were successively fed at intervals of 8 seconds so as to be subjected to heat treatment. The development duration for the sheet A was 20 seconds.

As can be understood from Table 2, division of the plate enabled the difference in the density that was a result of the heat development to be reduced as compared with the conventional structure. Thus, the quality of the heat treatment was improved.

TABLE 2

| | Comparative Example 2 | Example 2 |
|---|---|---|
| Divided Plates (Sheet Transfer Direction) | Not Divided 450 mm × 1 | Divided into three sections 150 mm × 3 |
| Irregular Density of Half-Cut Sheet (along the surface) | ΔD = 0.15 | ΔD = 0.08 |
| Irregular Density of Half-Cut Sheet (between surfaces) | ΔD = 0.2 | ΔD = 0.12 |

EXAMPLE 3

The heat treatment apparatus shown in FIG. 6 was used to make a comparison between a structure in which the plate-like heating member was divided into three sections (the first embodiment) and a structure in which a one-plate heating member was employed (Comparative Example 1).

The temperature of the plate was set. When the temperature was raised to the foregoing level, 20 half-cut sheets A were successively fed at intervals of 8 seconds so as to be subjected to heat treatment.

As can be understood from Table 3, division of the plate enabled the difference in the density that was a result of the heat development to be reduced as compared with the conventional structure. Thus, the quality of the heat treatment was improved.

TABLE 3

| | Comparative Example 3 | Example 3 |
|---|---|---|
| Divided Plates (Sheet Transfer Direction) | Not Divided 450 mm × 1 | Divided into three sections 150 mm × 3 |
| Temperature of the Plates | 120° C. | Plate 1: 100° C. Plate 2: 110° C. Plate 3: 120° C. |
| Heat Development Time | 20 Seconds | 25 Seconds |
| Irregular Density of Half-Cut Sheet (along the surface) | ΔD = 0.15 | ΔD = 0.05 |
| Irregular Density of Half-Cut Sheet (between surfaces) | ΔD = 0.2 | ΔD = 0.1 |

(Note) Plate 1 is disposed at the sheet inlet portion.

EXAMPLE 4

The fourth embodiment of the plate heaters of the heat treatment apparatus shown in FIG. 9 was employed to perform heat development. Temperature sensors 221, 222 and 223 corresponding to heaters 211, 212 and 213 are disposed at the rear ends of the plate. To prevent irregular temperature occurring in the boundaries among the heaters, the resistance wires of the adjacent heaters in the widthwise direction are wired in the zigzag configuration. The temperature of the plate was set to be 120° C. When the temperature was raised to the foregoing level, 20 half-cut sheets A were successively fed at intervals of 8 seconds so as to be subjected to heat treatment. The heat development duration was 20 seconds. The sheet A has a half-cut size (14"×17") or an eight by ten (8"×10").

As can be understood from Table 4, the heating means adjacent to the sheet inlet portion was divided into the three sections, which were heaters 211, 212 and 213, in the widthwise direction. Thus, the difference in the density which was a result of the heat development to be reduced if the sheet have the different width. Thus, the quality of the development was improved.

TABLE 4

| | Comparative Example 4 | Example 4 |
|---|---|---|
| Divided Plates (Sheet Transfer Direction) | Not Divided 450 mm × 1 | Divided into three sections 150 mm × 3 |
| Divided Heaters (Widthwise Direction) for only plate 1 | Not Divided 400 mm × 1 | Both ends of plate: 100 mm × 2 Center of plate: 200 mm × 2 |
| Temperature Sets | 120° C. | (Half-Cut) |

TABLE 4-continued

| | Comparative Example 4 | Example 4 |
|---|---|---|
| of the Heaters | (for both Half-Cut and Eight by Ten Sheets) | Heater 210: 120° C. Heaters 211–212: 125° C. (Eight by Ten Size) Heater210: 120° C. Heaters 211–212: 115° C. |
| Irregular Density of Half-Cut Sheet (between surfaces) | ΔD = 0.2 | ΔD = 0.12 |
| Irregular Density of Eight by Ten Size Sheet (between surfaces) | ΔD = 0.2 | ΔD = 0.12 |

The sheet A will now be described. The photographic photosensitive material includes a photosensitive material for use in a wet development method using processing solution including developing solution and fixing solution to convert a latent image formed on a photosensitive material into a visible image. Moreover, the photographic photosensitive material includes a photosensitive material for use in a dry development method that does not use the processing solution.

Examples of the dry development method include the following methods.

(1) A method in which a photosensitive material exposed to correspond to an image is laminated with an image receiving material, and then the laminate is heated (and applied with pressure, if necessary) so that an image corresponding to a latent image formed on the photosensitive material owing to the exposure is transferred to an image receiving material (for example, methods disclosed in Japanese Patent Laid-Open No. 5-113629, Japanese Patent Laid-Open No. 9-258404, Japanese Patent Laid-Open No. 9-61978, Japanese Patent Laid-Open No. 8-62803, Japanese Patent Laid-Open No. 10-71740, Japanese Patent Laid-Open No. 9-152705, Japanese Patent Application No. 10-90181, Japanese Patent Application No. 10-13326 and Japanese Patent Application No. 10-18172).

(2) A method with which a photosensitive material exposed to correspond to an image is laminated with a material, which must be processed, and then the laminate is heated so that an image corresponding to a latent image formed on the photosensitive material owing to the exposure is formed on the photosensitive material (for example, methods disclosed in Japanese Patent Laid-Open No. 9-274295 and Japanese Patent Application No. 10-17192).

(3) A method with which a photosensitive material having a photosensitive layer in which silver halide serving as a photocatalyst, silver salt serving as an image forming substance and reducing agent for silver ions are dispersed in a binder is exposed to correspond to an image after which the photosensitive material is heated to a predetermined temperature so that a latent image formed owing to the exposure is formed into a visible image (for example, methods disclosed in "Thermally Processed Silver Systems" (Imaging Processes and Materials) Neblette, Vol. 8, Sturge, V. Walworth and A. Shepp, pp. 2, 1996, Research Disclosure 17029 (1978), EP80376A1, EP803765A1 and Japanese Patent Laid-Open No. 8-211521).

(4) A method using a photosensitive and thermosensitive recording material and arranged such that a photosensitive and thermosensitive recording layer incorporates a recording material which has electron releasing colorless dye capsulated in a heat response microcapsule, a compound having, in the same molecule thereof, an electron receiving portion and a polymerizable vinyl monomer portion and a light polymerization initiator disposed on the outside of the microcapsule (for example, a method disclosed in Japanese Patent Laid-Open No. 4-249251). As an alternative to this, a method in which the photosensitive and thermosensitive recording layer incorporates a recording material having electron releasing colorless dye capsulated in a heat response microcapsule and an electron receiving compound, polymerizable vinyl monomer and a light polymerization initiator disposed on the outside of the microcapsule (for example, a method disclosed in Japanese Patent Laid-Open No. 4-211252).

In this specification, the photosensitive materials and the recording materials for use in the dry development method are collectively called the "heat development photosensitive material"). In the dry development methods (1) and (2), water in a small quantity may be used to enhance the development and image formation.

As described above, the heat treatment apparatus having the abovementioned structure and according to the present invention and the heat development apparatus using the same are arranged such that the heating member is divided in the direction in which the heat-development photosensitive material sheet or the photosensitive and thermosensitive recording material sheet is transferred and the temperatures of the corresponding heating members are independently set and controlled. Thus, the difference in the temperature of the sheet can be reduced. Moreover, irregular development that takes place owing to heat deterioration when the endless belt is used can be prevented. Furthermore uniform heating can be performed. As a result, a high-quality image free from irregular development can be obtained.

What is claimed is:

1. A heat treatment apparatus for subjecting a sheet to heat treatment by transferring the sheet along a surface of a heating member, said heat treatment apparatus comprising:

at least two heating members fixedly aligned in a direction in which the sheet is transferred and arranged to subject the sheet to heat treatment which is performed at a predetermined temperature;

transferring means for sliding and transferring the sheet along the surface of each of said heating members; and pressing means for pressing at least a portion of the sheet which is being transferred, against the surfaces of said heating members, wherein said pressing means is composed of a plurality of pressing rollers urged against the surfaces of said heating members, said pressing rollers being connected to rotating means and functioning as said transferring means.

2. A heat treatment apparatus according to claim 1, wherein the distance among said heating members is 50 mm or shorter.

3. A heat treatment apparatus according to claim 1, wherein the temperature of each heating member is independently controlled.

4. A heat treatment apparatus according to claim 3, wherein a temperature sensor is disposed at a most downstream position of each of said heating members.

5. A heat treatment apparatus according to claim 3, wherein a heat capacity of one of the heating members disposed in an upstream inlet portion in the direction in which the sheet, being subjected to heat treatment, is transferred, is larger than a heat capacity of another of the heating members disposed downstream.

6. A heat treatment apparatus according to claim 1, wherein each of the heating members incorporates an inclined sliding surface for sliding and guiding a leading end of the sheet, being subjected to heat treatment, at an upstream end in the direction in which the sheet is transferred.

7. A heat treatment apparatus according to claim 1, wherein said pressing rollers are rotated at a same peripheral velocity.

8. A heat treatment apparatus according to claim 1, wherein intervals of said pressing rollers provided for said heating members disposed in an upstream inlet portion in the direction in which the sheet is transferred is made to be closer than intervals of the pressing rollers of the other heating members.

9. A heat treatment apparatus according to claim 1, wherein a shaft of each pressing roller is able to move closer in a direction towards the surface of said heating member and away from said surface of said heating member by urging of a spring.

10. A heat treatment apparatus according to claim 9, further comprising a member for holding said spring to adjust a load of said spring so as to make a pressure of each pressing roller which is applied to the sheet to be the same.

11. A heat treatment apparatus according to claim 1, wherein a distance which each pressing roller is allowed to move backwards and forwards is in a range from 0.05 mm to 0.65 mm.

12. A heat treatment apparatus according to claim 1, further comprising a sub-roller disposed between said heating members and arranged to assist the transference of the sheet.

13. A heat treatment apparatus according to claim 1, wherein said heating members are one of aligned flat on a flat plate and aligned to form a circular-arc configuration on a plate warped in the transferring direction.

14. A heat treatment apparatus according to claim 1, wherein at least a portion of each heating member is made of heat-conductive rubber.

15. A heat treatment apparatus according to claim 1, wherein the surface of each heating member which makes contact with the sheet is one of coated with fluororesin and provided with a processed sheet composed of fluororesin.

16. A heat development apparatus for obtaining a visible image by transferring one of a photosensitive material sheet and a photosensitive and thermosensitive recording material sheet, on which a latent image has been formed and which is to be subjected to a heat-development, the sheet being in contact with a heating means, said heat development apparatus comprising:

at least two heating members fixedly aligned in a direction in which the one of heat-development photosensitive material sheet and the photosensitive and thermosensitive recording material sheet is transferred and arranged to subject either sheet to heat treatment which is performed at a predetermined temperature;

transferring means for sliding and transferring either sheet; and pressing means for pressing at least a portion of the sheet which is being transferred against surfaces of said heating members, wherein said pressing means is composed of a plurality of pressing rollers urged against the surfaces of said heating members, said pressing rollers being connected to rotating means and functioning as said transferring means.

17. A heat development apparatus according to claim 16, wherein said transferring means has a transference speed with which the sheet passes through a position of an outset gap between said heating members in the direction of the transference prior to a rise in a temperature of the sheet to a temperature at which development is started.

18. A heat development apparatus according to claim 17, wherein the transference speed is determined to cause the temperature of the sheet to be in such a range, wherein (room temperature +40° C.)<(the temperature of the sheet)< (development temperature −1° C.), at the position of the outset gap between said heating members in the direction of transference.

19. A heat treatment apparatus according to claim 16, wherein a temperature of each heating member is independently controlled.

20. A heat development apparatus according to claim 19, wherein one or more heating members are energized within a permitted electric power in a decreasing order of difference in temperature as compared with a set development temperature.

21. A heat development apparatus according to claim 16, wherein each of said heating members is composed of a heater having a ratio of a thermal capacity and a heating plate.

22. A heat development apparatus according to claim 16, wherein at least one of said heating members disposed in an upstream inlet portion in the direction in which the photosensitive and thermosensitive recording material sheet is transferred, is divided into at least three sections in a widthwise direction of the sheet, and a temperature of each of the heating members can independently be set.

23. A heat development apparatus according to claim 16, wherein adjacent heating members are disposed apart from one another for a predetermined gap in a state in which the adjacent heating members are engaged to one another in a comb tooth manner.

* * * * *